US006147290A

United States Patent [19]

Uno

[11] Patent Number: 6,147,290

[45] Date of Patent: Nov. 14, 2000

[54] ELECTRONIC MUSICAL INSTRUMENT KEYBOARD APPARATUS

[75] Inventor: Shiro Uno, Shizuoka, Japan

[73] Assignee: Roland Corporation, Los Angeles, Calif.

[21] Appl. No.: 09/295,922

[22] Filed: Apr. 21, 1999

[30] Foreign Application Priority Data

Apr. 22, 1998 [JP] Japan ..... 10-128260

[51] Int. Cl.[7] ..... G10C 3/12

[52] U.S. Cl. ..... 84/433; 84/423 R; 84/744

[58] Field of Search ..... 84/433, 423 R, 84/744

[56] References Cited

U.S. PATENT DOCUMENTS

| | | | |
|---|---|---|---|
| 3,903,780 | 9/1975 | Aliprandi | 84/433 |
| 4,672,876 | 6/1987 | Sugiyama et al. | 84/1.03 |
| 4,681,008 | 7/1987 | Morikawa et al. | 84/1.28 |
| 5,243,125 | 9/1993 | Yamaguchi | 84/745 |
| 5,247,128 | 9/1993 | Suzuki | 84/611 |
| 5,796,023 | 8/1998 | Kumane et al. | 84/433 |

FOREIGN PATENT DOCUMENTS

| | | |
|---|---|---|
| 63-62759 | 12/1986 | Japan . |
| 05120847 | 5/1993 | Japan . |
| 06195071 | 7/1994 | Japan . |
| 06230770 | 8/1994 | Japan . |
| 06348254 | 12/1994 | Japan . |
| 07168569 | 7/1995 | Japan . |
| 7-36389 | 8/1995 | Japan . |
| 2528586 | 2/1996 | Japan . |
| 09022288 | 1/1997 | Japan . |
| 09146554 | 6/1997 | Japan . |
| 10049166 | 2/1998 | Japan . |

OTHER PUBLICATIONS

Roland Corporation, *R–8 Human Rhythm Composer*, Owner's Manual, 1988, pp. 3–5, 11, 27, 58, 61–64.

Roland Corporation, *R–8 Human Rhythm Composer*, Owner's Manual, 1988, pp. 3–5, 11, 14–15, 17, 40–42.

Roland Corporation, *Multitrack Manager Software—DM–80–S*, Owner's Manual, pp. 1–5, 9, 10 (No Date provided).

Roland Corporation, *Digital Studio Workstation, VS–880*, Owner's Manual, 1996, pp. 5–7, 10–13, 22.

Roland Corporation, *MIDI Pad–MIDI Interface, PM–16*, Owner's Manual, pp. 1, 2, 17–31, 60–63 (No Date provided).

Roland Corporation, *JV–2080, 64 Voice Synthesizer Module, 3x EFX 8x Expansion*, Owner's Manual, 1996, pp. 4, 5, 12–14, 63–66, 70, 71, 76.

Roland Corporation, Paul D. Lehram, *Roland S–770 Digital Sampler with SYS–772 Version 2.0 Operating System*, 1991, Table of Contents, pp. 76, 83–93.

BOSS, *SP–202, Dr. Sample*, Owner's Manual, pp. 4–7, 12, 14 (No Date Provided).

*Primary Examiner*—Paul Ip
*Assistant Examiner*—Shin-yung Hsieh
*Attorney, Agent, or Firm*—Foley & Lardner

[57] ABSTRACT

Preferred embodiments include a jack holder 48 that is free to swing in accordance with the depression operation of a key 10, a first elastic member 52 that impels the jack holder 48 and applies the first counter force to the key 10 against the key depression action, the jack 42 that, together with being established so that it is not possible for it to swing with respect to the jack holder 48 during the depression operation of the key 10, is also established so that it is free to swing with respect to the jack holder 48 during the releasing operation of the key 10 and the second elastic member 56 that impels the jack 42 and applies the second counter force, which is smaller than the first counter force, to the key 10 against the key releasing action.

33 Claims, 18 Drawing Sheets

ELECTRONIC MUSICAL INSTRUMENT KEYBOARD APPARATUS

RELATED APPLICATIONS

This application claims priority to Japanese patent applications Heisei 10-128260 filed Apr. 22, 1998, which is assigned to the applicant and is incorporated herein.

FIELD OF THE INVENTION

The present invention is directed to an electronic musical instrument keyboard apparatus. More specifically, embodiments of the instant invention are directed to an electronic musical instrument keyboard apparatus wherein the touch sensation of a key of the keyboard apparatus simulates the touch sensation of a key on a keyboard of an acoustic piano.

BACKGROUND OF THE INVENTION

In general, for acoustic pianos, at the time of depressing a key on a keyboard in an acoustic piano, a static load change and an advance withdrawal sensation occurs wherein the advance withdrawal sensation is referred to as the "let-off sensation". An example of an electronic musical instrument keyboard apparatus, wherein the let-off sensation has been simulated, is disclosed in Japanese Laid-Open Patent Publication Number Hei 6-230770.

The apparatus disclosed in Japanese Laid-Open Patent Publication Number Hei 6-230770 includes a key that is supported by one end on the keyboard chassis so that it is free to swing. The apparatus further includes a hammer that is free to swing in accordance with the depressing of the key and a roller that together with being arranged in a position where it is engaged on the locus of the swinging movement of one end of the hammer, is supported by one end of an elastic body so that it is free to swing. The apparatus is configured so that immediately prior to the termination of the depressing process of the key, one end of the hammer is engaged with the roller and the static load that accompanies the key depressing is increased due to the resistance of the elastic body. When the key depressing process is terminated, the engagement between the end of the hammer and the roller is canceled and the static load that accompanies the key depressing is reduced. Thus, the let-off sensation that occurs in an acoustic piano is simulated.

Although the electronic musical instrument keyboard apparatus disclosed in Japanese Laid-Open Patent Publication Number Hei 6-230770 simulates the let-off sensation of the acoustic piano, a problem occurs during the key releasing process. Namely, when the key depressing is terminated and the key returns to its initial non-depressed position, the end of the hammer also engages the roller such that the static load that accompanied the return of the key is increased due to the resistance of the elastic body. This leads to a change in the increase in the static load during the key releasing process. This change can adversely affect the performance.

More specifically, in the case of an acoustic piano, one cannot say that there is no change in the static load when the key depressing is terminated and the key returns to its position prior to depressing, but that static load change is extraordinarily small and does not hinder the performance. However, in the case of the electronic musical instrument keyboard apparatus disclosed in Japanese Laid-Open Patent Publication Number Hei 6-230770, because the roller is supported by a single elastic body, the counter force that is received from the elastic body is equal both at the time of key depressing and when the key returns and, thus, there is also an increase in the static load when the key depressing is terminated and the key returns to its position prior to depressing. In the case of the electronic musical instrument keyboard apparatus disclosed in Japanese Laid-Open Patent Publication Number Hei 6-230770, when it is made so that the static load is reduced when the key depressing is terminated and the key returns to its position prior to depressing, the let-off sensation at the time of key depressing is also reduced such that it is not possible to obtain the let-off sensation of an acoustic piano.

Embodiments of the present invention consider the problems of the technology of the past that have been described above. At least one objective of embodiments of the instant invention is to present an electronic musical instrument keyboard apparatus which, without losing the let-off sensation at the time of key depressing, is made so that the change in the static load when the key depressing is terminated and the key returns to its position prior to depressing is markedly lessened. In this manner, it is possible to obtain a touch sensation that is equal to the touch sensation of an acoustic piano without adversely affecting the performance.

To reduce the change in the static load, in embodiments of the electronic musical instrument keyboard apparatus of the present invention, it is possible to independently adjust both the first counter force to the key which contributes to the change in the static load at the time of key depressing and the second counter force to the key which contributes to the change in the static load at the time that the key depressing is terminated and the key returns to its position prior to depressing. The apparatus is configured so that the adjustment of both the static load for the let-off sensation at the time of key depressing and the static load when the key depressing is terminated and the key returns to its position prior to depressing is independently achieved. In this manner, the let-off sensation is achieved independently at the time of key depressing and when the key depressing is terminated due to the independent adjustment of the static loads during the key depression and key release. As such, the change in the static load when the key depressing is terminated and the key returns to its position prior to depressing is markedly lessened without losing the let-off sensation at the time of key depressing, thereby allowing the attainment of a touch sensation that is equal to the touch sensation of an acoustic piano without adversely affecting the performance.

SUMMARY OF THE INVENTION

Embodiments of the present invention comprise a first swingable member, a first biasing means and a first counter force. The first swingable member is configured so that it can freely swing in accordance with the depressing action of the key. The first biasing means applies a bias to the first swingable member and applies the first counter force to the key that resists the depressing action. Embodiments of the present invention further comprise a second swingable member, a second biasing means and a second counter force. The second swingable member is configured such that it cannot swing with respect to the first swingable member during the depressing action of the key. Further, the second swingable member is configured to freely swing with respect to the first swingable member during the releasing action of the key. The second biasing means applies a bias to the second swingable member and applies a second counter force to the key that resists the releasing action, wherein the second counter force is smaller than the first counter force. In accordance with the depressing action of the key, in a portion of the depressing process for the key, the first swingable member and the second swingable member swing as a unit against the biasing due to the first biasing means. In accordance with the releasing action of the key, in a portion of the releasing process for the key, the second swingable member swings independently against the biasing due to the second biasing means.

Thus, in accordance with embodiments of the present invention, due to the portion of the depressing process for the key, wherein the first swingable member and the second swingable member swing as a unit against the biasing due to the first biasing means through adjustment of the first biasing means, it is possible to adjust the static load at the time of key depressing. In addition, due to the portion of the releasing process for the key, wherein the second swingable member independently swings against the biasing due to the second biasing means, through adjustment of the second biasing means, it is possible to adjust the static load at the time of releasing the key. Because of this, the change in the static load when the key depressing is terminated and the key returns to its position prior to depressing is markedly lessened without losing the let-off sensation at the time of key depressing. As such, it is possible to obtain a touch sensation that is equal to the touch sensation of an acoustic piano without adversely affecting the performance. Further, for the second biasing means, the biasing force may be produced by an elastic body or the biasing force may be produced by the dead load of the second swingable member.

In addition, embodiments of the present invention include a hammer that is established so that it is free to swing in accordance with the depressing action of the key. In the portion of the depressing process for the key, the hammer and the second swingable member are engaged. Together with the swinging movement of the hammer, the first swingable member and the second swingable member swing as a single unit with the swinging movement fulcrum of the first swingable member as the center of the swinging movement. The engagement between the hammer and the second swingable member is then canceled. In a portion of the releasing process for the key, the hammer and the second swingable member are engaged and, together with the swinging movement of the hammer, the second swingable member swings independently with the swinging movement fulcrum of the second swingable member as the center of swinging movement. Thus, in accordance with embodiments of the present invention, it is possible to obtain a substantial touch sensation by means of the inertia of the swinging movement action of the hammer. Moreover, due to the engagement of the second swingable member with the hammer, there is no longer any necessity to establish a space below the key especially for the arrangement of such things as the second swingable member. In addition, because the swinging movement angle of the hammer is greater than that of the key, that is, the distance of the swinging movement is longer, the result is that the design of the engagement location with the second swingable member is easy to implement.

Further, in embodiments of the present invention the swinging movement fulcrum of the second swingable member is established more on the side in the direction of the swinging movement of the first swingable member than the line extended from the engagement locus of the hammer and the second swingable member and the swinging movement fulcrum of the first swingable member. Prior to the cancellation of the engagement between the hammer and the second swingable member, when the key is released, at least the second swingable member swings with the swinging movement fulcrum of the second swingable member as the center of swinging movement. Thus, in accordance with preferred embodiments of the present invention, when the key has been released prior to the cancellation of the engagement of the hammer and the second rotating member, the generation of unsatisfactory action can be prevented without impeding the swinging movement action of the second swingable member.

Preferred embodiments of the present invention further include a shock absorbing member that is established at the engagement locus of the hammer and the second swingable member, wherein the shock absorbing member is formed in a single unit with the second biasing means. Thus, in accordance with embodiments of the present invention, the shock at the time of the engagement of the hammer and the second swingable member can be absorbed by the shock absorbing member. Moreover, because the shock absorbing member and the second biasing member are formed as a single unit, the configuration is not complicated. Further, due to the configuration, there is no increase in the number of structural components.

In addition, embodiments of the present invention have a swingable member that is established so that it can freely swing in accordance with the depressing action of the key and an elastic member that together with applying a bias to the swingable member and applying a first counter force to the key that resists the depressing action, the elastic member applying a second counter force to the key that resists the releasing action, wherein the second counter force is smaller than the first counter force. In accordance with the depressing action of the key, in a portion of the depressing process for the key, the swingable member swings against the first counter force. Similarly, in accordance with the releasing action of the key, in a portion of the releasing process for the key, the swingable member swings against the second counter force. Thus, in accordance with embodiments of the present invention, because, in a portion of the depressing process for the key, the swingable member swings against the first counter force, the static load at the time of key depressing can be adjusted by means of the suitable adjustment of the elastic member. In addition, because, in a portion of the releasing process for the key, the swingable member swings against the second counter force, it is possible to adjust the static load at the time of key releasing by means of the adjustment of the elastic member. Because of this, the change in the static load when the key depressing is terminated and the key returns to its position prior to depressing is lessened without losing the let-off sensation at the time of key depressing. As such, it is possible to obtain a touch sensation that is equal to the touch sensation of an acoustic piano without adversely affecting the performance.

Because the present invention is configured in the manner described above, it exhibits an advantageous result that it is possible to lessen the change in the static load at the time that the depression of the key is terminated and the key returns to the position prior to depression without losing the let-off sensation at the time of the depression of the key. This allows a touch sensation that is equal to that of an acoustic piano to be obtained without hindering the performance.

The above and other advantages of embodiments of this invention will be apparent from the following more detailed description when taken in conjunction with the accompanying drawings. It is intended that the above advantages can be achieved separately by different aspects of the invention and that additional advantages of this invention will involve various combinations of the above independent advantages such that synergistic benefits may be obtained from combined techniques.

BRIEF DESCRIPTION OF THE DRAWINGS

The detailed description of preferred embodiments of the invention will be made with reference to the accompanying drawings, wherein like numerals designate corresponding parts in the figures.

FIG. 9(*b*) is a plane diagram of the jack in accordance with a preferred embodiment.

FIG. 9(*c*) is a lateral diagram of the jack in accordance with a preferred embodiment.

FIG. 10(*b*) is a lateral diagram that shows the operation state of the let-off unit at the time of key depression in accordance with another preferred embodiment.

FIG. 10(*c*) is a lateral diagram that shows the operation state of the let-off unit at the time of key releasing in accordance with another preferred embodiment.

FIG. 11(*b*) is a lateral diagram that shows the operation state of the let-off unit at the time of key depression in accordance with another preferred embodiment.

FIG. 11(*c*) is a lateral diagram that shows the operation state of the let-off unit at the time of key releasing in accordance with another preferred embodiment.

FIG. 12(*b*) is a lateral diagram that shows the operation state of the let-off unit at the time of key depression in accordance with another preferred embodiment.

FIG. 12(*c*) is a lateral diagram that shows the operation state of the let-off unit at the time of key releasing in accordance with another preferred embodiment.

FIG. 17(*b*) is the lateral cross-section of FIG. 17(*a*) depicting the action conditions of the let-off unit in the key depressing process.

FIG. 17(*c*) is the lateral cross-section of FIG. 17(*a*) depicting the action conditions of the let-off unit in the key depressing process.

FIG. 17(*d*) the lateral cross-section of FIG. 17(*a*) depicting the action conditions of the let-off unit in the key releasing process.

FIG. 17(*e*) the lateral cross-section of FIG. 17(*a*) depicting the action conditions of the let-off unit in the key releasing process.

FIG. 18(*b*) depicts a frontal elevation of another preferred embodiment of jack holder and jack of the let-off unit.

FIG. 19(*b*) depicts of lateral outline elevation of the let-off unit of the preferred embodiment of FIG. 17(*a*).

FIG. 19(*c*) depicts of bottom outline elevation of the let-off unit of the preferred embodiment of FIG. 17(*a*).

FIG. 20(*b*) depicts the coupling of the let-off unit to the main body.

FIG. 20(*c*) depicts the locking of the let-off unit to the main body.

DETAILED DESCRIPTION OF PREFERRED EMBODIMENTS

Below, a detailed description of preferred embodiments of the electronic musical instrument keyboard apparatus in accordance with the present invention based, in part, on the attached figures will be given.

Figure 1:
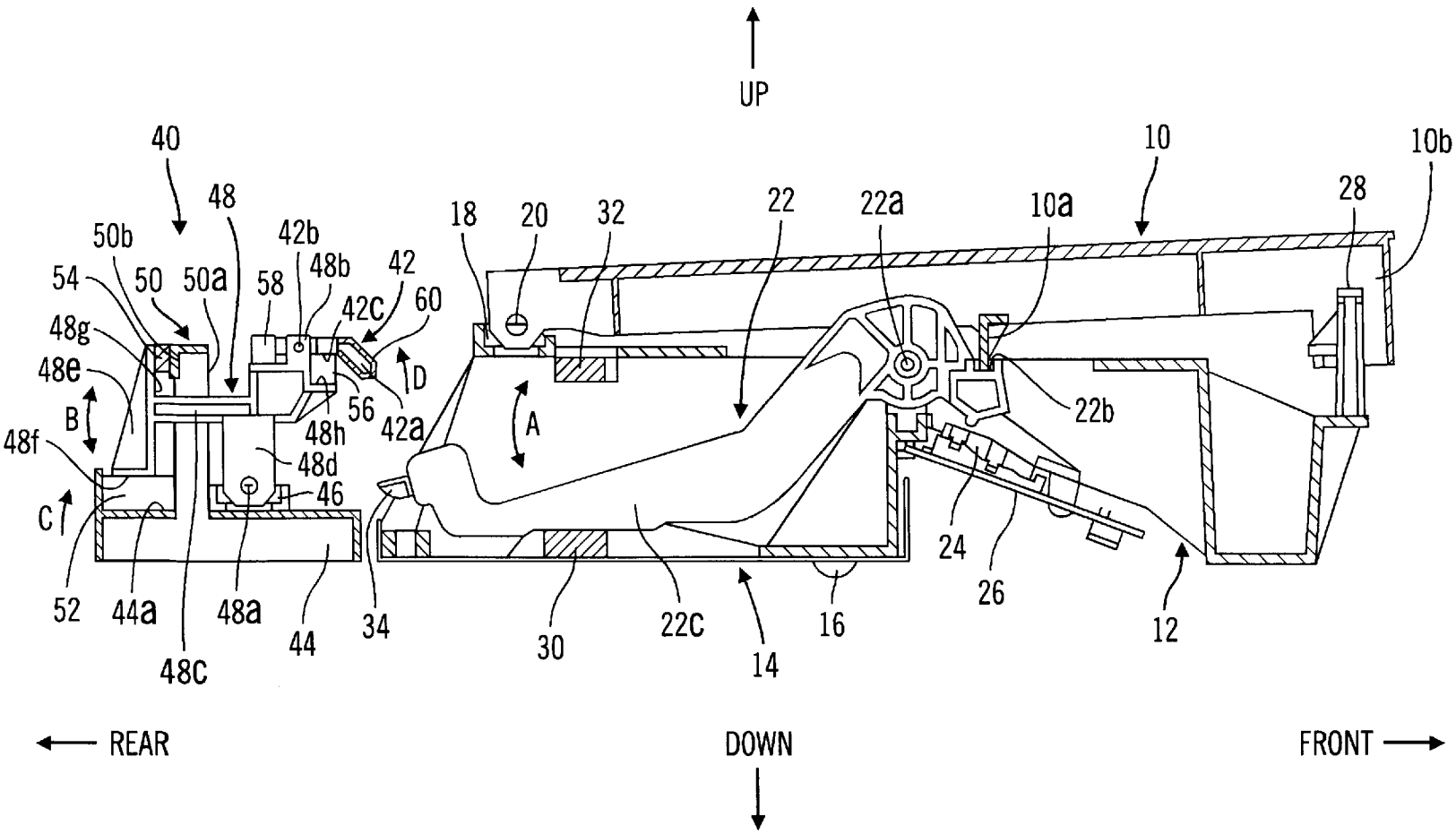
FIG. 1 depicts a cross-section diagram that shows a preferred embodiment of the electronic musical instrument keyboard apparatus in accordance with the present invention.
Figure 2:
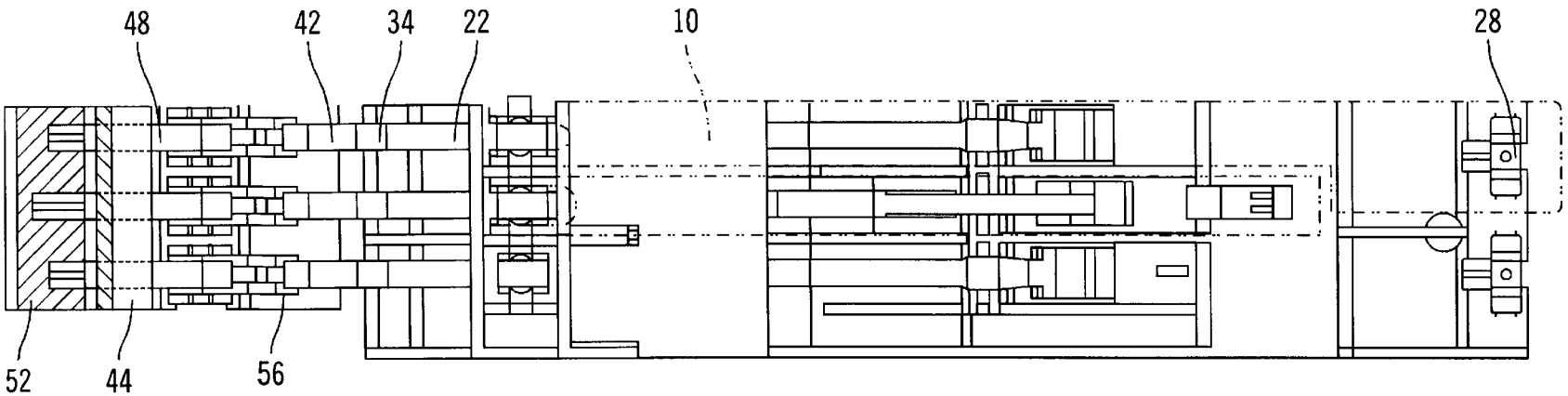
FIG. 2 is a plane diagram of a portion of the electronic musical instrument keyboard apparatus shown in FIG. 1.
Figure 3:
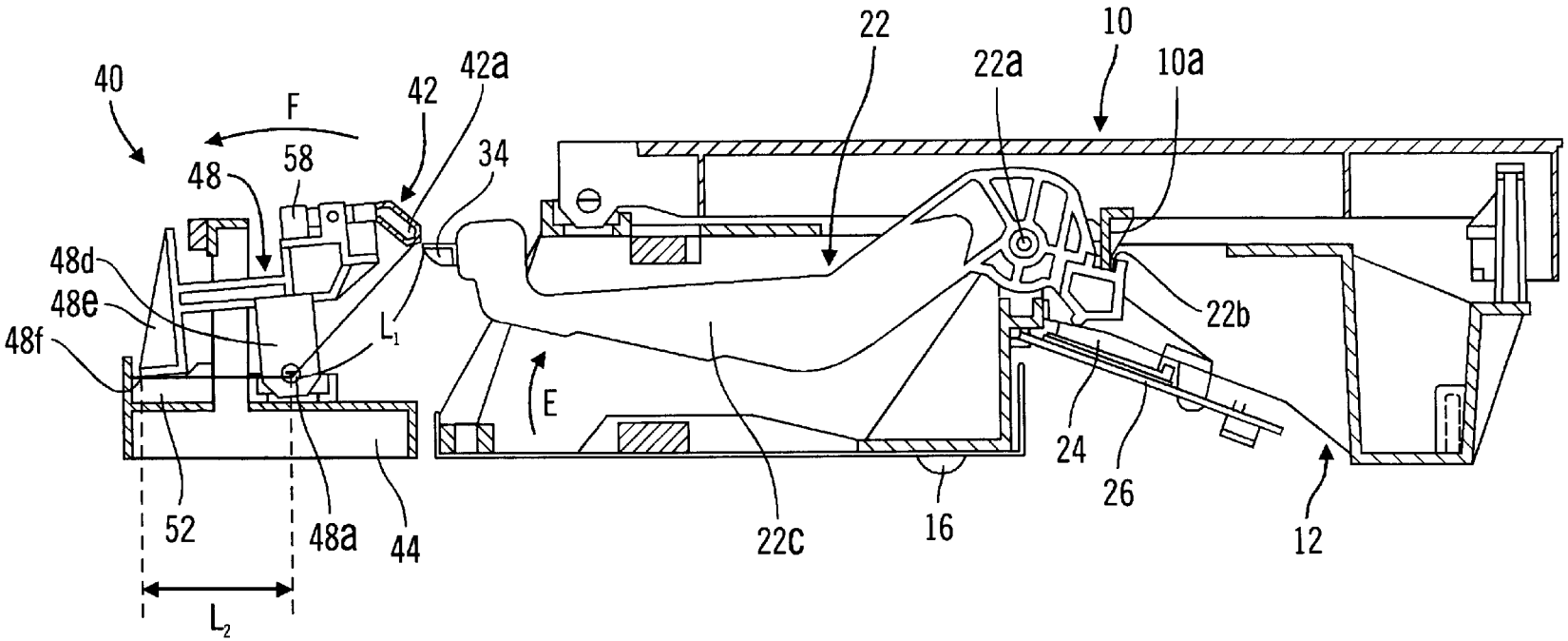
FIG. 3 is a lateral cross-section diagram that shows the state in the midst of key depression for the electronic musical instrument keyboard apparatus shown in FIG. 1.
Figure 4:
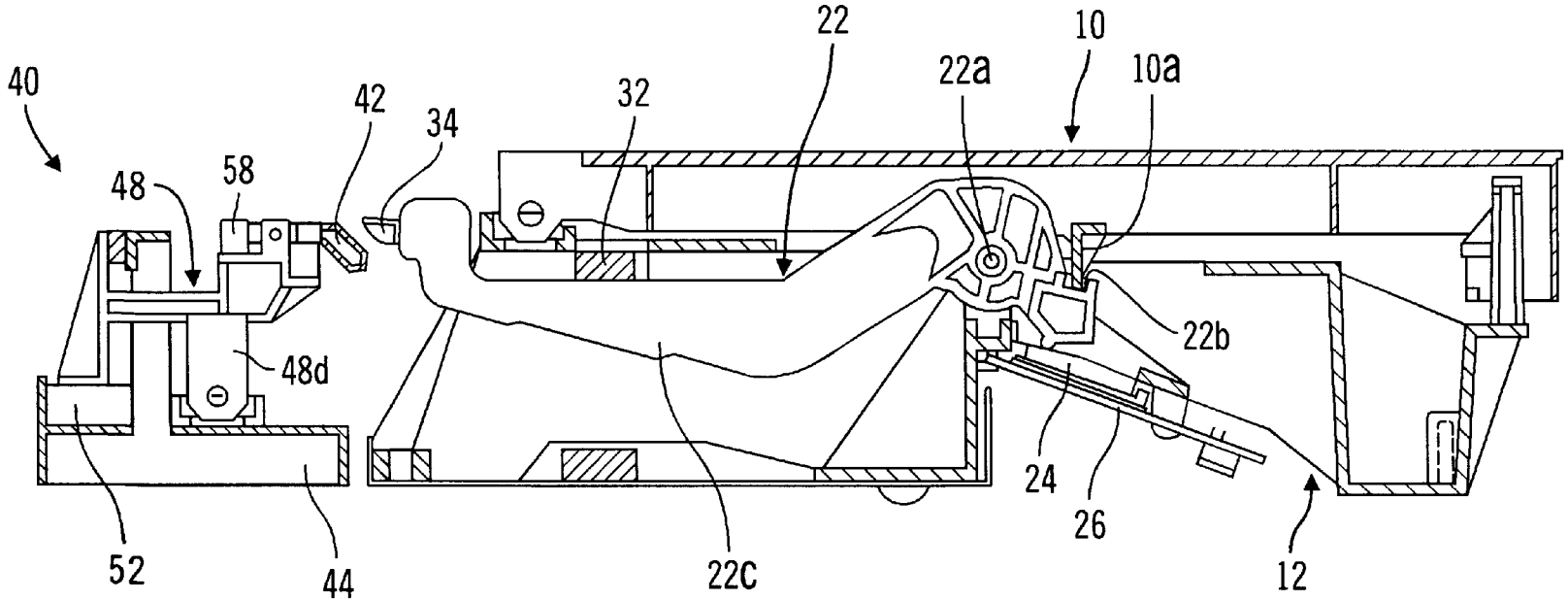
FIG. 4 is a lateral cross-section diagram that shows the state at the time of the termination of key depression for the electronic musical instrument keyboard apparatus shown in FIG. 1.
Figure 5:
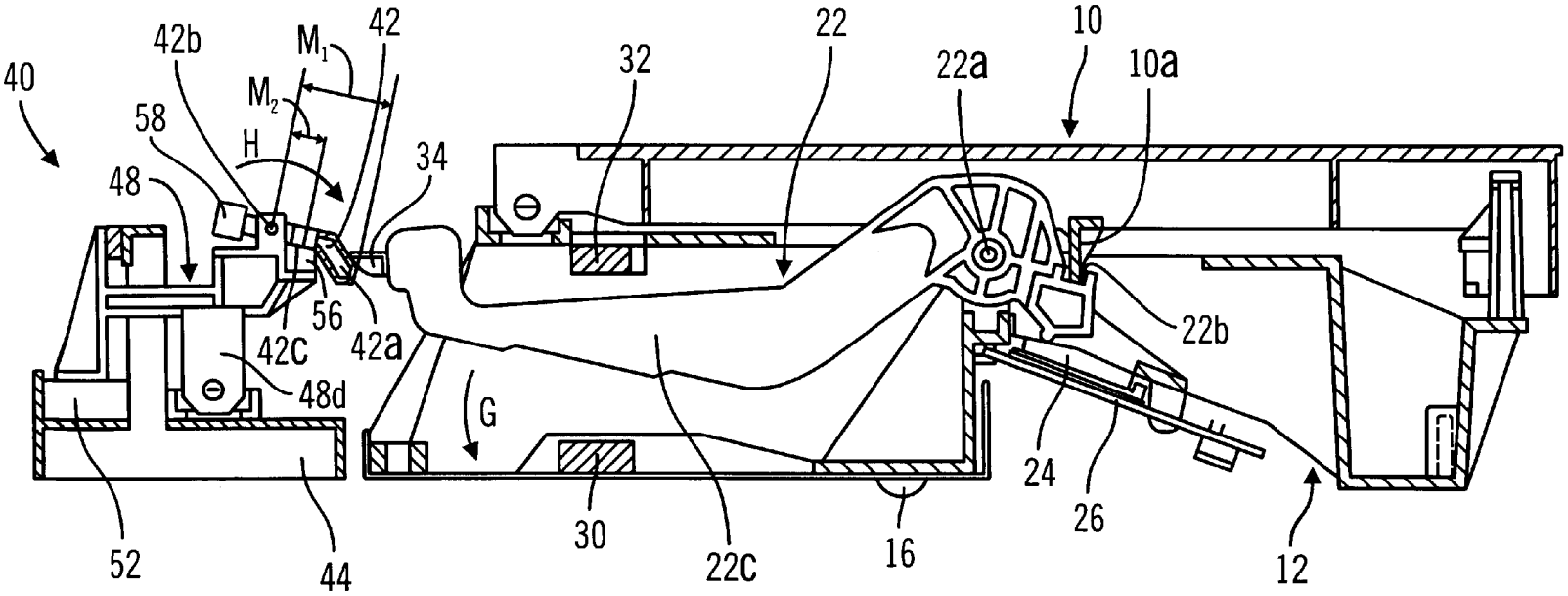
FIG. 5 is a lateral cross-section diagram that shows the state in the midst of the key return following the termination of key depression for the electronic musical instrument keyboard apparatus shown in FIG. 1

FIG. 1 is a lateral cross-section diagram that shows the releasing state of a preferred embodiment of an electronic musical instrument keyboard apparatus in accordance with the present invention. FIG. 2 shows a partial plane drawing of the electronic musical instrument keyboard apparatus shown in FIG. 1. FIG. 3 shows a cross-section diagram that depicts the state of the electronic musical instrument keyboard apparatus shown in FIG. 1 in the midst of key depression. FIG. 4 shows a cross-section diagram that depicts the state of the electronic musical instrument keyboard apparatus shown in FIG. 1 at the time of key depression termination. FIG. 5 shows a cross-section diagram that depicts the electronic musical instrument keyboard apparatus shown in FIG. 1 in the midst of the key return period following key depression termination.

In FIGS. 1, 3, 4 and 5, the configuration of a key that the keyboard apparatus comprises is shown. It is to be understood that this key configuration is established for the total number of keys in an actual keyboard apparatus. For example, if the number of keys in a keyboard apparatus is 88, this configuration represents each of the 88 keys.

In FIG. 1, key number 10 is a key which is either a white key or a black key in a keyboard apparatus that is used in an electronic musical instrument such as an electronic piano. Key number 12 is the keyboard chassis, which is coupled to a bottom chassis 14 on the mounting surface by coupling means such as a screw 16. In some preferred embodiments, the keyboard chassis is made from resin.

The key 10 is supported through a swing support shaft 20 by a key bearing section 18 on the upper end of the rear of the keyboard chassis 12.

Key number 22 is a transmitting member, referred to herein as a hammer which is provided with a form that is bent in a crank shape. The hammer 22 is supported on the upper area at about the middle of the keyboard 20 chassis 12 so that it is free to swing by a swing support shaft 22*a* that is formed on the front end. Key number 24 is a switch that, together with being arranged on the contact substrate 26 that is supported by the keyboard chassis 12, is for sound generation control accompanying the key depressing operation and the key releasing operation that is established for the key 10.

An actuator 10*a* is formed on the bottom of the key 10. The lower end of the actuator 10*a* is in contact with an actuator receiving section 22*b* that is formed on the upper surface of the front end of the hammer 22.

In addition, the key guide support section 10*b* is formed in a single body with the key 10 and extends vertically downward on the front end of the key 10. This key guide support section 10*b* is engaged so that it is free to slide with a key guide 28 that is formed on the front end of the key chassis 12 and regulates the key 10 so that there is not a shifting in position produced at the time of the swinging action due to key depression and key releasing. In addition, by means of this key guide 28, the upper position and the lower position of the key 10 at the time of the swinging action are also regulated.

On the upper surface of the bottom of the rear of the keyboard chassis 12, a lower stopper 30, which is formed from a resilient material such as rubber, elastomer or felt, is arranged in contact with the arm section 22*c* of the hammer 22 in order to regulate its range of swinging movement and to absorb shock. During swinging, the lower limit of the hammer 22 is regulated by the contact of the arm section 22*c* of the hammer 22 with the stopper 30.

Further, on the lower surface of the key bearing support 18 of the keyboard chassis 12, an upper stopper 32, which is formed from a resilient material such as rubber, elastomer or felt, is arranged in contact with the arm section 22*c* of the hammer 22 in order to regulate its range of swinging movement and to absorb shock. The upper limit of the hammer 22 during swinging is regulated by the contact of the arm section 22*c* of the hammer 22 with the upper stopper 32.

To obtain an inertial mass, the hammer 22 is formed primarily from a heavy metallic material such as lead or iron that is covered with a resin. Further, the hammer 22 is configured so that, with the swing support shaft 22*a* as the fulcrum, the arm section 22*c* side is heavier compared to the front end.

A tongue plate 34 protrudes from the rear end of the hammer 22. The tongue plate is capable of engaging the front end 42*a* of the jack 42, which is arranged on the let-off unit 40, at the time that the hammer 22 makes a swinging movement. For the jack 42 and the tongue plate 34, the dimensions are set so that when the hammer 22 swings in the arrow A direction of FIG. 1, due to the depression or the releasing of the key 10, the jack 42 and tongue plate 34 engage on the locus of the swinging movement of the hammer 22 in the midst of the key depression and, then, as the key depression advances beyond the jack 42, the engagement is canceled. Similarly, the jack 42 and tongue-plate 34 engage on the locus of the return swinging movement of the hammer 22 at the time that the key returns following the termination of the key depression and, when the key return advances beyond the jack 42, the engagement is again canceled.

The let-off unit 40 comprises a base chassis 44, a jack holder 48 and a jack 42. The base chassis 44 is made of resin, wherein the base chassis 44 is coupled to the mounting surface of the main body of the keyboard apparatus, by for example, a screw (not shown in the figure), and forms the base of the let-off unit 40. The jack holder 48 is supported through the swing support shaft 48*a* so that it is free to swing by the bearing section 46 that is formed on the upper section in about the middle of the base chassis 44. The jack 42 is supported through the swing support shaft 42*b* so that it is free to swing by the bearing section 48*b* that is formed on the upper section in the front of the jack holder 48.

In some preferred embodiments, the base chassis 44 is made, for example, in units for the number of keys 10 for one octave. In other preferred embodiments, the base chassis 44 is made as a single unit with the keyboard chassis 12.

Next, an explanation will be given further detailing the let-off unit 40. The jack holder receiving member 50 is formed having the slit 50*a* fashioned protruding in the vicinity of the rear of the bearing section 46 of the base chassis 44.

The jack holder 48 comprises a linkage member 48*c* that is mounted so that it is free to swing in the arrow B direction of FIG. 1 in the slit 50*a* of the jack holder receiving member 50. The first member 48*d*, which is linked to the linkage member 48*c*, is positioned on the bearing section 46 side. The first member 48*d* holds the jack holder receiving member 50 on one side and the second member 48*e*, which is linked to the linkage member 48*c*, is positioned in the rear holding the jack holder receiving member 50 on the other side.

In addition, between the lower surface 48*f* of the second member 48*e* and the upper surface 44*a* of the back of the base chassis 44, the first elastic member 52 is arranged in order to impart a biasing force that biases the jack holder 48 in the arrow C direction of FIG. 1 (in FIG. 1, this is a clockwise direction) with the swing support shaft 48*a* as the fulcrum. The first elastic member 52 is a member that imparts a biasing force in order to obtain a static load that provides a let-off sensation and is configured from a resilient material such as, for example, a sponge, rubber or elastomer.

In preferred embodiments, the first elastic member 52, which is any kind of spring such as a coil spring, is used with each jack holder 48, that is, one elastic member 52 is attached to each corresponding key 10. However, in other preferred embodiments, a belt-shaped elastic member is attached such that it extends across the number of keys in the keyboard apparatus. For example, if the number of keys in the keyboard apparatus is 88, then it is for 88 keys. The single elastic member across the entire key set simplifies the manufacturing process and is efficacious from the standpoint of manufacture.

In addition, on the wall surface 50*b* of the jack holder receiving member 50, that is opposite the side wall 48*g* of the second member 48*e*, the stopper 54, which is formed from a resilient material such as rubber, elastomer or felt, is arranged in contact with the side wall 48*g* in order to regulate its range of swinging movement and to absorb the shock caused by the side wall 48*g* contacting the stopper 54. The range of swinging movement of the jack holder 48, which swings in the direction of the arrow C in FIG. 1 due to the biasing force of the first elastic member 52, is regulated by the contact between the side wall 48*g* of the second member 48*e* and the stopper 54.

In addition, the bearing section 46 is formed in the manner on the upper area of the first member 48*d* of the jack holder 48 and the jack 42 is supported so that it is free to swing by the bearing section 48*b* through the swing support shaft 42*b*.

Further, between the lower surface 42*c* of the front end 42*a* side of the jack 42 and the upper surface 48*h* of the first member 48*d,* the second elastic member 56 is arranged to impart a biasing force that biases the jack 42 in the arrow D direction of FIG. 1 (in FIG. 1, this is a counterclockwise direction) with the swing support shaft 42*b* as the fulcrum. This second elastic member 56 is a member that imparts a biasing force in order to adjust the change in the static force when the key depression is terminated and the key 10 returns. The second elastic member 56 is configured from a resilient material, including, but not limited to, a sponge, rubber or elastomer, although, any resilient material is suitable similar to the first elastic member 52, the second elastic member 56 may be any kind of spring, such as a coil spring that is attached for each jack 42, that is, one second elastic member is attached to each corresponding key 10.

In addition, the biasing force of the second elastic member 56 is sufficient if it supports the mass of the jack 42 and is set weaker than the biasing force of the first elastic member 52. For example, when the second elastic member 56 is configured by using a resilient material having a weak biasing force such as a soft sponge, it is possible to change the static force at the time of the return of the key 10 without limit to approach zero.

With reference to FIG. 3, the biasing force at the time of key depression is adjusted by the means of such things as the distance $l_1$ between the swing support shaft 48*a* and the front end 42*a* of the jack 42 (the length from the leverage point to the shaft), the distance $l_2$ between the swing support 48*a* and the lower surface 48*f* of the second member 48*e* (the length from the shaft to the action point), the elastic constant of the first elastic member 52 and the area for the contact of the lower surface 48*f* of the second member 48*e* with the first elastic member 52. It is designed so that the performer is able to experience the desired let-off at the time of key depression.

In addition, with reference to FIG. 5, the biasing force at the time of key releasing is adjusted by the means of such things as the distance m, between the swing support shaft 42*b* and the front end 42*a* of the jack 42 (the length from the leverage point to the shaft), the distance $m_2$ between the swing support shaft 42*b* and the lower surface 42*c* of the jack 42 (the length from the shaft to the action point), the elastic constant of the second elastic member 56 and the area for the contact of the lower surface 42*c* of the jack 42 with the second elastic member 56. Because it is designed for the magnitude of the degree of support for the jack 42, the performer has almost no sensation of the biasing force.

In addition, the stopper 58, which is formed from a resilient material such as rubber, elastomer or felt, is arranged on the rear end of the jack 42 and is in contact with the upper surface of the first member 48*d* to regulate the range of the swinging movement to absorb the shock at the time of impact. By means of the contact between the upper surface of the first member 48*d* and the stopper 58, the range of the swinging movement of the jack 42, shown in FIG. 1, arrow D, due to the biasing force of the second elastic member 56, is regulated. In addition, the front end 42*a* of the jack 42 is covered by the shock absorbing member 60, which is formed from a resilient material such as rubber, elastomer or felt, to absorb the shock at the time of the contact and engagement with the tongue plate 34 of the hammer 22.

Figure 6:
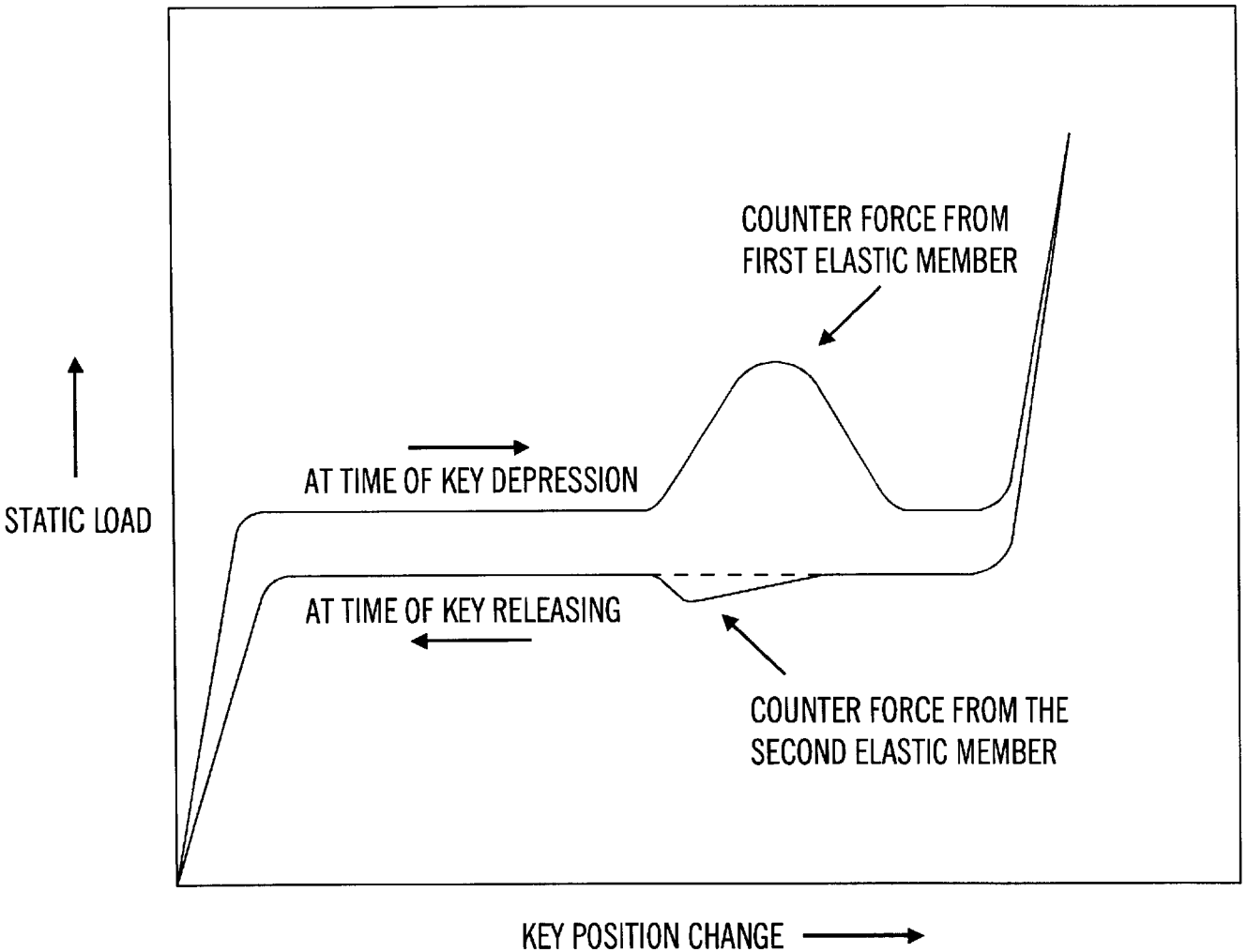
FIG. 6 is a graph that shows the relationship between the amount of change in the key position and the change in the static load.

In the above configuration, when the key 10 is depressed from the state that is shown in FIG. 1 (the state in which the key 10 is released), the actuator receiving section 22*b* of the hammer 22 is pressed down by the actuator 10*a* of the key 10 and the hammer 22 is swung in the arrow E direction shown in FIG. 3 with the swing support shaft 22*a* as the fulcrum. When the swinging operation of the hammer 22 in the arrow E direction of FIG. 3 advances in this manner, the tongue plate 34 and the jack 42 are in contact and engage and the jack 42 is swung in the arrow F direction shown in FIG. 3 together with the swinging movement of the hammer 22. At this time, because the swinging of the jack 42 is regulated by the contact of the stopper 58 and the upper surface of the first member 48*d,* together with the swinging movement of the hammer 22 in the arrow E direction of FIG. 3, the jack 42 and the jack holder 48 become one body and swing in the arrow F direction shown in FIG. 3 against the biasing force of the first elastic member 52 and compress the first elastic member 52. Thus, by means of the counter force that is imparted to the key 10 by the compression of the first elastic member 52, the static load at the time of the depression of the key 10 is increased as is shown in FIG. 6.

In addition, when the swinging movement of the hammer 22 in the arrow E direction of FIG. 3 advances with the depression of the key 10, the engagement between the tongue plate 34 and the jack 42 is canceled (refer to FIG. 4). Further, the static load at the time of the depression of the key 10 is reduced (refer to FIG. 6) and it is possible to obtain a let-off sensation. Because the engagement between the tongue plate 34 and the jack 42 is canceled, the jack 42 and the jack holder 48 are restored to a state that is the same as the state shown in FIG. 1 due to the biasing force of the first elastic member 52.

With reference to FIG. 4, at the time of the termination of the depression of the key 10 (in other words, when the key 10 is depressed so that the keystroke is a full stroke key depression), the arm section 22*c* of the hammer 22 comes into contact with the stopper 32 and its range of swinging movement is regulated. By means of the inertia of the swinging movement of the hammer 22 in this manner, it is possible to obtain a substantial touch sensation.

When the key 10 returns from the time of the termination of the key depression shown in FIG. 4, in other words, from the state following the depression of the key 10 so that the keystroke is a full stroke key depression, the hammer swings in the arrow G direction of FIG. 5 due to its own weight with the swing shaft 22*a* as the support point. When the swinging movement of the hammer 22 advances in the arrow G direction of FIG. 5, the tongue plate 34 and the jack 42 come into contact and are engaged. Together with the swinging movement of the hammer 22 in the arrow G direction shown in FIG. 5, the jack 42 resists the biasing force of the second elastic member 56 and compresses the second elastic member 56, wherein the jack 42 swings in the direction of the arrow H shown in FIG. 5. At this time, due to the use of various materials, such as, for example, a sponge as the second elastic member 56, as the biasing force of the second elastic member 56 can be made extremely small, the counter force that is imparted to the key 10 from the compression can be made extremely small. As shown in FIG. 6, it is possible to markedly reduce the static load at the time of the release of the key 10 such that the performance is not adversely affected.

By adjustment of the biasing force of the second elastic member 56, it is possible to bring the level of the static load to nearly zero without limit (the state that is shown by the broken line in FIG. 6) by means of the counter force that is imparted to the key 10 by the second elastic member 56. Together with the swinging movement in the arrow G direction of FIG. 5 of the hammer 22, the actuator 10*a* of the key 10 is pushed upward by the actuator receiving section 22. In addition, the arm section 22*c* of the hammer 22 collides with the stopper 30, wherein the arm section 22*c* and hammer 22 rest in contact with each other. With this, the range of the swinging movement of the hammer 22 is regulated and the key 10 and the hammer 22 are reinstated to the state that is shown in FIG. 1.

By means of the electronic musical instrument keyboard apparatus that has been described above, in comparison to the technology of the past, it is possible to reduce the change in the static load at the time that the depression of the key 10 is terminated, such that the key 10 returns to the position prior to depression without substantially losing the let-off sensation existing at the time of the depression of the key 10. As such, a touch sensation that is equivalent to that of an acoustic piano can be obtained.

Figure 7:
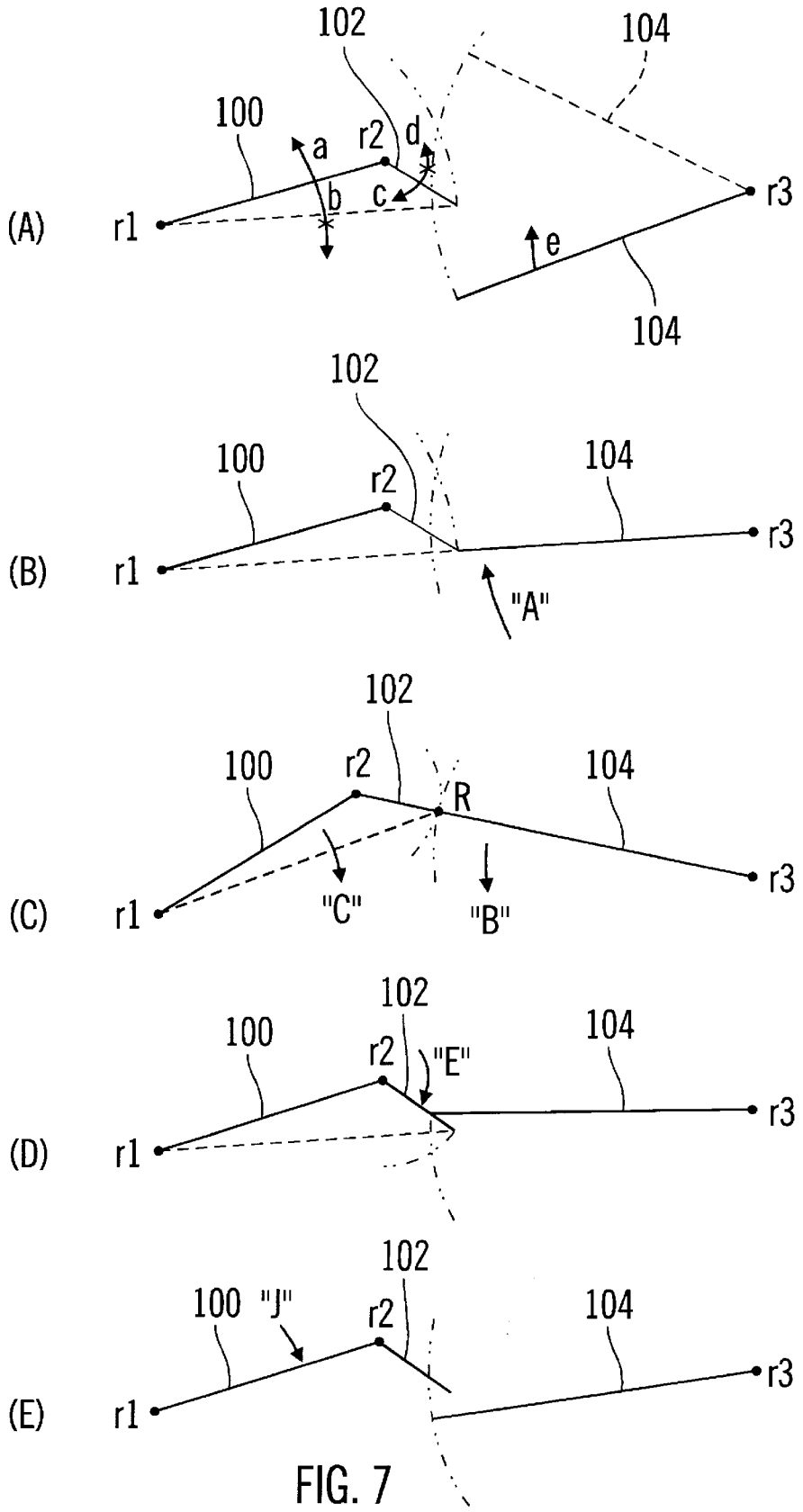
FIG. 7 is a schematic diagram of the action at the time of the depression and releasing operations of the key.
Figure 8:
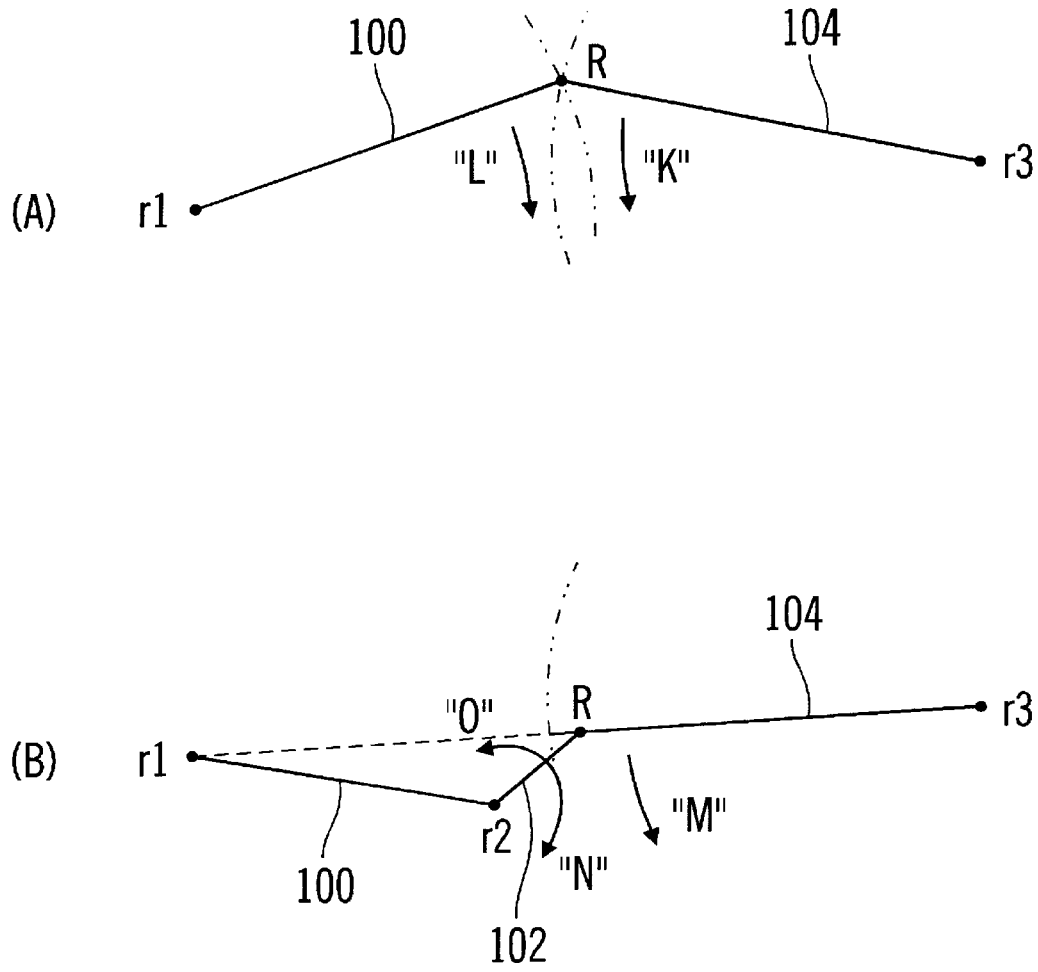
FIG. 8 is a schematic diagram of the action at the time of the depression and releasing operations of the key.

With reference to FIGS. 7 and 8, a more detailed explanation of the action that accompanies the depression and releasing operations of the key 10 will be given.

In FIG. 7 and FIG. 8, the first swingable member 100 is equivalent to the jack holder 48 that is established to freely swing with the swing support shaft 48*a* as the fulcrum. The swing shaft r1 of the first swingable member 100 is equivalent to the swing support shaft 48*a* of the jack holder 48. In addition, the second swingable member 102 is equivalent to the jack 42 that is established to freely swing with the swing support shaft 42*b* as the fulcrum. The swing shaft r2 of the second swingable member 102 is equivalent to the swing support shaft 42*b* of the jack 42. Further, the hammer, indicated by the key number 104 is equivalent to the hammer 22 that has the tongue plate 34 arranged to freely swing with the swing support shaft 22*a* as the fulcrum. The swing shaft r3 of the hammer 104 is equivalent to the swing support shaft 22*a*.

FIG. 7(A) shows the initial state in which the key 10 has not been depressed. The first swingable member 100 can swing in the arrow "a" direction from the initial position that is shown in FIG. 7(A) and is impelled in the arrow "b" direction by the first elastic member, which is equivalent to the first elastic member 52 (not shown in the figure), so as to return to the initial state shown in FIG. 7(A). In addition, the first swingable member 100 is regulated so as not to swing in the arrow "b" direction beyond the initial position.

The second swingable member 102 is configured to swing in the arrow "c" direction from the initial state that is shown in FIG. 7(A) and is impelled in the arrow "d" direction by the second elastic member, which is equivalent to the second elastic member 56 (not shown in the figure), so as to return to the initial state shown in FIG. 7(A). In addition, the swing angle of the second swingable member 102 is regulated so as not to swing in the arrow "d" direction beyond the initial position with respect to the first swingable member 100.

The hammer 104 swings in the arrow "e" direction from the initial state shown in FIG. 7(A) in response to the key depression operation. When the depressed key state is canceled, the hammer 104 returns to the initial state shown in FIG. 7(A) due to the mass of the hammer 104.

With regard to the positional relationships among the swing shaft r1, the swing shaft r2, the engagement area of the second swingable member 102 and the hammer 104 (the tip section of the second swingable member 104), the swing shaft r2 is always set so that it is positioned above a line extended between the swing shaft r1 and the engagement section, that is, the swing movement direction side of the first swingable member 100.

As shown in FIG. 7(B), when the key depressing operation is performed, the hammer 104 swings in the arrow "e" direction (see FIG. 7(A)) and, when the swinging movement is only the amount of swing that is indicated by the arrow "A," the hammer 104 is engaged with the tip section of the second swingable member 102. When the key depression operation is further performed and the hammer 104 swings in the arrow "e" direction, because the second swingable member 102 is regulated so that it does not swing in the arrow "d" direction, the second swingable member 102 becomes a single body with the first swingable member 100 and swings with the swing shaft r1 as the fulcrum. Due to the engagement between the hammer 104 and the second swingable member 102, the counter force from the biasing force of the first elastic member which impels the first swingable member 100 is transmitted to the performer through the hammer 104.

When the hammer 104 swings further in the arrow "e" direction due to the key depression, it becomes the state depicted in FIG. 7(C). When the key is depressed even further, the engagement between the hammer 104 and the second swingable member 102 is canceled. With the return of the first swingable member 100 and the second swingable member 102 to the initial state shown in FIG. 7(A), the hammer 104 swings further in the arrow "e" direction and is raised upward. In addition, in the moment when the engagement between the hammer 104 and the second swingable member 102 is canceled, the counter force from the biasing force of the first elastic member, which, up to that point, had been transmitted to the performer through the hammer 104, disappears. Due to the disappearance of the counter force, it is possible for the performer to feel a let-off sensation.

With reference to FIG. 7(A), an explanation will be given of the releasing action. The state of the hammer 104 at the time that the key depression has been terminated is shown by the broken line in FIG. 7(A). Further, the positions of the first swingable member 100, as well as, the second swingable member 102, are the same as the position of the initial state.

When the releasing action advances, the hammer 104 is engaged with the second swingable member 102. Because it is possible for the second swingable member 102 to swing in the arrow "c" direction, the second swingable member 102 swings independently in the arrow "c" direction due to the mass of the hammer 104. At this time, as the second swingable member 102 is impelled by the second elastic member, the counter force from the biasing force of the second elastic member acts with the hammer 104. Because the biasing force of the second elastic member is an extraordinarily small biasing force compared to the biasing force of the first elastic member, the counter force from the biasing force of the second elastic member can hardly be sensed by the performer. As the releasing action advances further, the engagement between the hammer 104 and the second swingable member 102 is canceled. Together with the return of the first swingable member 100 and the second swingable member 102 to the initial state, shown in FIG. 7(A), the hammer 104 also returns to the initial state in accordance with the releasing action.

With reference to FIG. 7(C), an explanation will be given of the case where, in the state immediately prior to let-off, the key is released in the midst of the key depression. In FIG. 7(C), the point R is the engagement area between the second swingable member 102 and the hammer 104, wherein the hammer 104 swings in the arrow "B" direction from R due to the mass of the hammer 104. The first swingable member 100 is configured so that it swings in the arrow "C" direction and is impelled by the first elastic member. In other words, because there is a mutually pressing force that is operating among the first swingable member 100, the second swingable member 102 and the hammer 104, wherein the hammer 104 has a force that seeks to shorten the distance between the swing shaft r1 and the point R, as is shown in FIG. 7(D), the second swingable member 102 swings in the arrow "E" direction with the swing shaft r2 as the fulcrum.

In addition, when the key releasing action advances, as is shown in FIG. 7(E), the engagement between the second swingable member 102 and the hammer 104 is canceled. Together with the return of the first swingable member 100 and the second swingable member 102 to the initial state shown in FIG. 7(A), the hammer 104 also returns to the initial state in accordance with the key releasing action.

With reference to FIG. 8(A), with a configuration in which the second swingable member 102 is not present, in a state immediately prior to let-off, when the key is released in the midst of the key depression, the hammer 104 attempts to swing in the arrow "K" direction due to its mass. Further, the first swingable member 100 attempts to swing in the arrow "L" direction. The swinging of the hammer 104 and first swingable member 100 generates a mutually pressing force between and, as a result, there is a possibility that the hammer 104 and the first swingable member 100 will be unable to return to the initial state.

In addition, as is shown in FIG. 8(B), even with a configuration in which the second swingable member 102 is present, in a case where the positional relationship among the swing shaft r1, the swing shaft r2 and the engagement area between the second swingable member 102 and the hammer 104, point R, is made so that the position of the swing shaft r2 is lower than the line that is extended between the swing shaft r1 and the engagement area (the opposite side of the swinging direction of the first swingable member 100). In the same manner as is shown in the case of FIG. 8(A), in the state immediately prior to let-off, when the key is released in the midst of the key depression, the hammer 104 attempts to swing in the arrow "M" direction due to its mass and the first swingable member 100 attempts to swing in the arrow "N" direction. However, because the second swingable member 102 is not able to swing in the "O" direction, a mutually pressing force is generated between the first swingable member 100, the second swingable member 102 and the hammer 104. As a result of this force, there is a possibility that the first swingable member 100, the second swingable member 102 and the hammer 104 will be unable to return the initial state shown in FIG. 7(A).

To prevent the generation of the states such as those shown in FIG. 8(A) and FIG. 8(B) described above, it is preferable that the positional relationships among the swing shaft r1, the swing shaft r2 and the engagement area between the second swingable member 102 and the hammer 104 (the tip section of the second swingable member 102) be established, as shown in FIG. 7(A) through FIG. 7(E), wherein the swing shaft r2 resides above the line which extends between the swing shaft r1 and the engagement area (the swing direction side of the first swingable member 100).

Each of the configurations of the embodiment that are shown in FIG. 1, FIG. 2, FIG. 3, FIG. 4, FIG. 5, FIG. 6, FIG. 7 and FIG. 8 correspond to each of the configuration outlines for claim 1 as shown below. In other words, the first swingable member in claim 1 corresponds to the jack holder 48, the first biasing means in claim 1 corresponds to the first elastic member 52, the second swingable member in claim 1 corresponds to the jack 42 and the second biasing means in claim 1 corresponds to the second elastic member 56.

Figure 9:
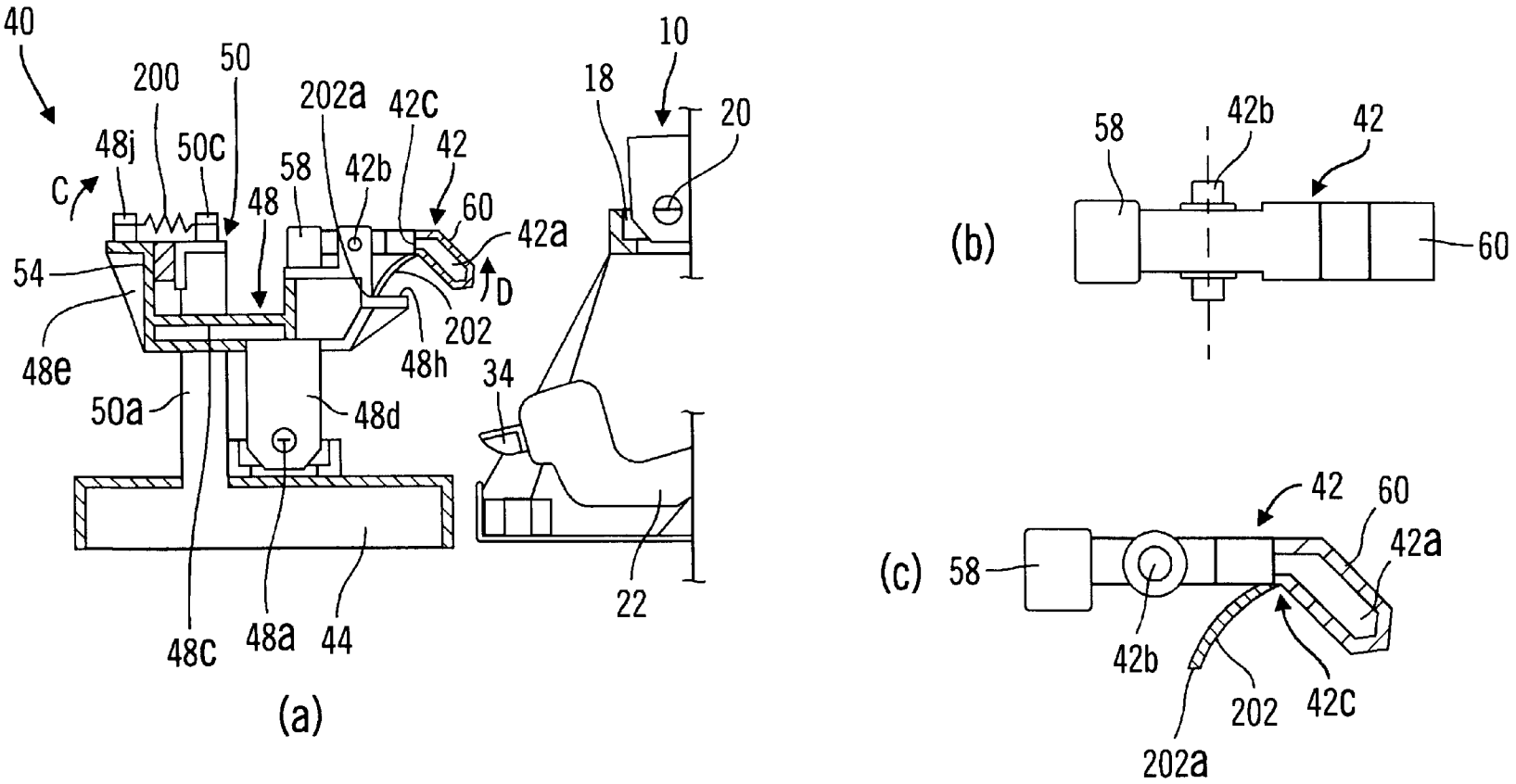
FIG. 9(*a*) is a lateral cross-section diagram of the essential elements with the let-off unit as the center in accordance with a preferred embodiment.

With reference to FIGS. 9(*a*)–(*c*), an explanation will be given regarding another preferred embodiment of the electronic musical instrument keyboard apparatus in accordance with the present invention. In FIGS. 9(*a*)–(*c*), the identical key numbers are employed for the structures that are identical or equivalent to those of the configuration of FIGS. 1–8.

FIG. 9(*a*) depicts a cross-section diagram of the let-off unit of another preferred embodiment of the electronic musical instrument keyboard apparatus in accordance with the present invention. In FIG. 9(*b*) a plane diagram of the jack 42 is shown and, in FIG. 9(*c*), a lateral surface diagram of the jack 42 is shown.

In this preferred embodiment, a coil spring 200 having a biasing force in the contraction direction as a substitute for the first elastic member 52. Further, the plate-shaped spring member 202, which has a biasing force in the expansion direction and is formed in a single body with the shock absorbing member 60, is used as a substitute for the second elastic member 56.

Thus, in this preferred embodiment, the coil spring 200, which has a biasing force in the compression direction, is established stretched between the anchoring section 50*c* that is established on the upper surface of the jack holder receiving member 50 and the anchoring section 48*j* that is established on the upper surface of the second member 48*e*. Thus, by means of the biasing force of the coil spring 200, the jack holder 48 is ordinarily biased in the arrow C direction of FIG. 9(*a*) (the clockwise direction of FIG. 9(*a*)), wherein the swing support shaft 48*a* is the fulcrum.

In addition, the plate-shaped spring member 202, which has a biasing force in the expansion direction, is established extending from the lower surface 42*c* on the front end section 42*a* side of the jack 42. The plate-shaped spring member is formed as a single body with the shock absorbing member 60, wherein the shock absorbing member 60 covers the front end 42*a* of the jack 42. As such, the plate-shaped member 202 is formed from the same material as the shock absorbing member 60. The tip section 202*a* of the plate-shaped spring section 202 is anchored to the upper surface 48*h* of the first member 48*d*. Thus, by means of the biasing force of the plate-shaped spring member 202, the jack 42 is ordinarily biased in the arrow D direction of FIG. 9(*a*) (the counterclockwise direction of FIG. 9(*a*)) with the swing support shaft 42*b* as the fulcrum. By means of suitable adjustment of the respective bias forces of the coil spring 200 and the plate-shaped spring 202, it is possible to obtain the same action and effect as previously described for other preferred embodiments.

It is to be understood that the structural elements shown in FIG. 9 correspond to each of the claimed structural elements. For instance, the first swingable member corresponds to the jack holder 48, the first biasing means corresponds to the coil spring 200, the second swingable member corresponds to the jack 42, the second biasing means corresponds to the plate-shaped spring member 202 and the shock absorbing member corresponds to the shock absorbing member 60.

Figure 10:
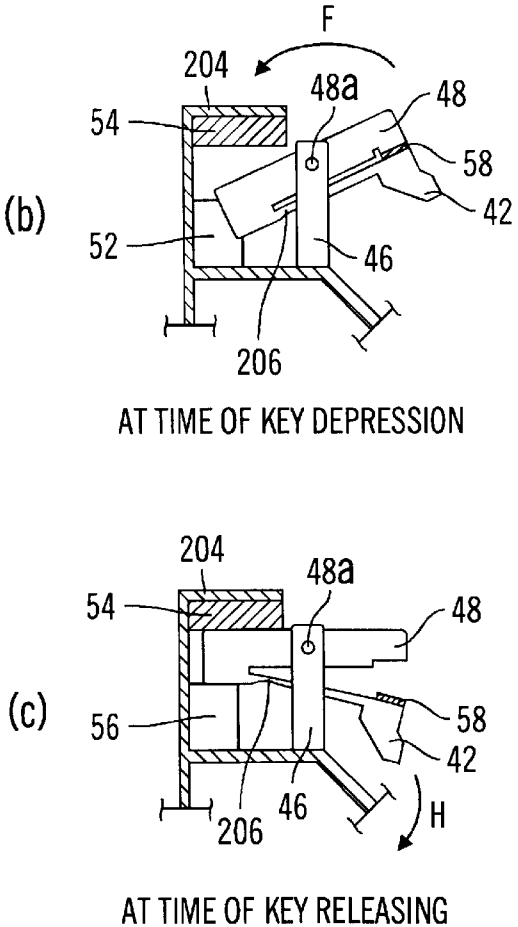
FIG. 10(*a*) is a lateral cross-section diagram of the essential elements with the let-off unit as the center in accordance with another preferred embodiment.
Figure 10:
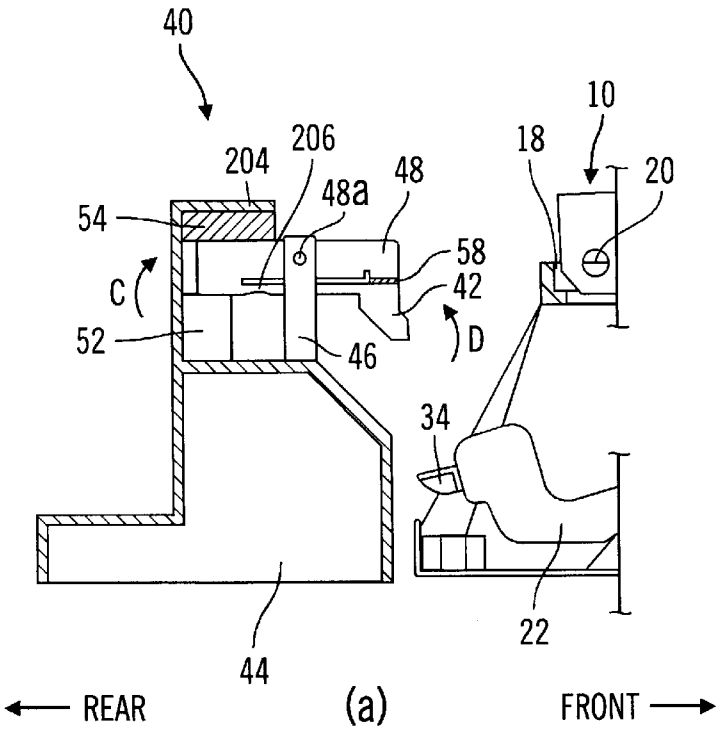

With reference to FIGS. 10(*a*)–(*c*), an explanation will be given regarding another preferred embodiment of the electronic musical instrument keyboard apparatus of the present invention. It is to be understood that in FIGS. 10(*a*)–(*c*), identical key numbers which were used for the previously described embodiments are employed for the structures that are identical or equivalent.

FIG. 10(*a*) depicts a cross-section diagram of the let-off unit of another preferred embodiment of the electronic musical instrument keyboard apparatus in accordance with the present invention. In FIG. 10(*b*), a lateral diagram that depicts the operating state of the let-off unit at the time of key depression is shown and, in FIG. 10(*c*), a lateral diagram that depicts the operating state of the let-off unit at the time of key release is shown.

In this preferred embodiment, the bearing section 46 is formed in the area above the base chassis 44 and the jack holder 48 is supported by the bearing section 46 through the swing support shaft 48*a* such that it is free to swing. In preferred embodiments, the jack holder 48 is made from materials, which include, but are not limited to, resin, elastomer or rubber.

The first elastic member 52 is arranged between the lower surface of the end on the rear side that has the swing support shaft 48*a* of the jack holder 48 as its center and the upper surface of the base chassis 44. The first elastic member 52 impels the jack holder 48 in the arrow C direction of FIG. 10(*a*) (the clockwise direction of FIG. 10(*a*)), wherein the swing support shaft 48*a* is the fulcrum.

In addition, on the lower surface of the roof member 204 of the base chassis 44, that is opposite the end on the rear side that has the swing support shaft 48*a* of the jack holder 48 as its center, the stopper 54 is arranged so that when it comes into contact with the end section on the rear side of the jack holder 48 by regulating the range of its swinging movement, the stopper 54 absorbs the shock of the impact. In some preferred embodiments, the stopper 54 is formed from a resilient material such as, but not limited to, rubber, elastomer or felt which aids in the absorption of shock due to the impact. By means of the contact by the end section on the rear side of the jack holder 48, the range of the swinging movement of the jack holder 48 in the arrow C direction of FIG. 10(*a*) due to the biasing force of the first elastic member 52 is regulated.

In preferred embodiments, the jack 42 is formed as a single body with the jack holder 48 on the lower area of the jack holder 48. In other words, the jack 42 is made into a single body with the jack holder 48 through the curved shaped elastic area 206 (in this preferred embodiment, the curved shaped elastic area 206 is used as a substitute for the second elastic member 56) that possesses a biasing force, similar to the second elastic member 56, to impel the jack 42 in the arrow D direction of FIG. 10(*a*) (the counterclockwise direction of FIG. 10(*a*)). Thus, it is advantageous from a manufacturing standpoint to produce the jack holder 48, the curved elastic area 206 and the jack 42 as a single body from materials such as resin.

On the upper surface of the jack 42, the stopper 54 is arranged so that when it comes into contact with the lower surface of the jack holder 48 by regulating the range of its swinging movement, the stopper 54 absorbs the shock of the impact. In some preferred embodiments, the stopper 54 is formed from a resilient material such as, but not limited to, rubber, elastomer or felt which aids in the absorption shock due to the impact. By means of the contact by the lower surface of the jack holder 48, the range of the swinging movement of the jack holder 48 in the arrow D direction of FIG. 10(*a*) due to the biasing force of the curved shaped elastic area 206 is regulated.

Thus, at the time of the key depression, the jack 42 and the tongue plate 34 are engaged accompanying the swinging action of the hammer 22. Further, the jack 42 and the jack holder 48 couple as a single body and are swung in the arrow F direction of FIG. 10(*b*) against the biasing force of the first elastic member 52 (refer to FIG. 10(*b*)). When the swinging movement of the hammer 22 advances further due to the depression of the key, the engagement between the jack 42 and the tongue plate 34 is canceled and the key depression is terminated.

In addition, at the time of the return of the key following the termination of the key depression, together with the swinging action due to the mass of the hammer 22, only the jack 42 is swung in the arrow H direction of FIG. 10(*c*) against the biasing force of the curved shaped elastic area 206 (refer to FIG. 10(*c*)). Following that, the jack 42 is restored to the state shown in FIG. 10(*a*). By means of a suitable adjustment of the respective biasing forces of the first elastic member 52 and the curved shaped elastic area 206, it is possible to obtain an action and effect that is the same as those previously described.

As previously stated, each of the structures that are shown in FIG. 10 correspond to claimed structural elements. For instance, the first swingable member corresponds to the jack holder 48, the first biasing means corresponds to the first elastic member 52, the second swingable member corresponds to the jack 42 and the second biasing means corresponds to the curved shaped elastic area 206.

Figure 11:
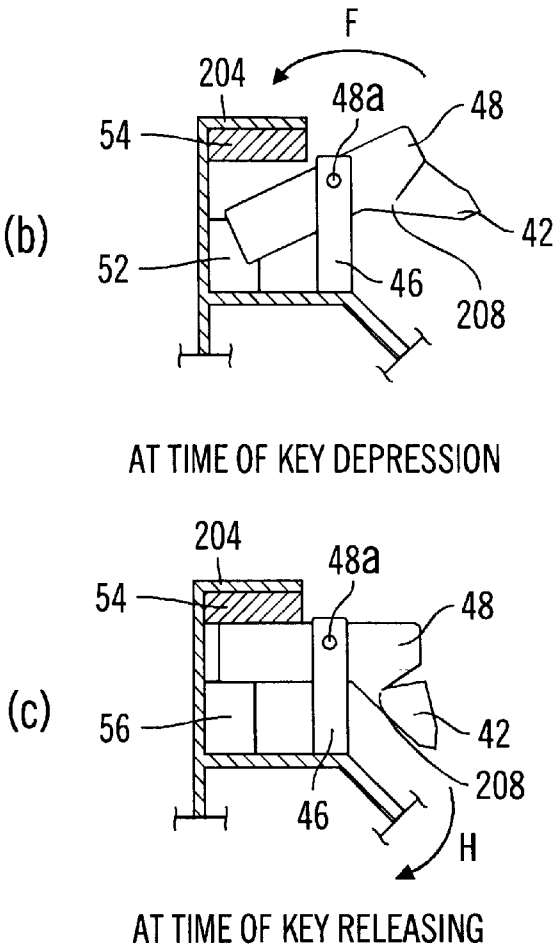
FIG. 11(*a*) is a lateral cross-section diagram of the essential elements with the let-off unit as the center in accordance with another preferred embodiment.
Figure 11:
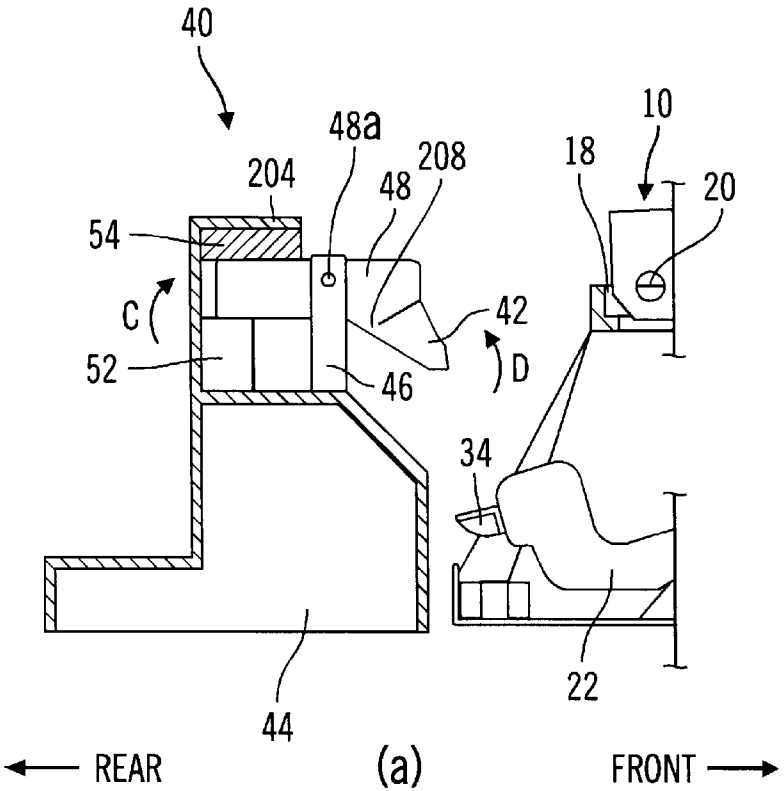

With reference to FIGS. 11(*a*)–(*c*), an explanation will be given regarding yet another preferred embodiment of the electronic musical instrument keyboard apparatus of the present invention. As with other figures, in FIGS. 11(*a*)–(*c*), identical key numbers as were used for previously described embodiments are employed for the structures that are identical or equivalent to the structures in the previously described embodiments.

FIG. 11(*a*) depicts cross-section diagram of the let-off unit of a preferred embodiment of the electronic musical instrument keyboard apparatus in accordance with the present invention. In FIG. 11(*b*), a lateral diagram that depicts the operating state of the let-off unit at the time of key depression is shown and, in FIG. 11(*c*) a lateral diagram that depicts the operating state of the let-off unit at the time of key release is shown.

In this embodiment, the bearing section 46 is formed in the area above the base chassis 44 and the jack holder 48 is supported by the bearing section 46 through the swing support shaft 48*a* so that it is free to swing. In preferred embodiments, the jack holder 48 is made from materials, such as, but not limited to, resin, elastomer or rubber.

The first elastic member 52, which impels the jack holder 48 in the arrow C direction of FIG. 11(*a*) (the clockwise direction of FIG. 11(*a*)) wherein the swing support shaft 48*a* is the fulcrum, is arranged between the lower surface of the end on the rear side that has the swing support shaft 48*a* of the jack holder 48 as its fulcrum and the upper surface of the base chassis 44. In addition, on the lower surface of the roof member 204 of the base chassis 44, that is opposite the end on the rear side that has the swing support shaft 48*a* of the jack holder 48 as its center, the stopper 54 is arranged so that when it comes into contact with the end section on the rear side of the jack holder 48 by regulating the range of its swinging movement, the stopper 54 absorbs the shock of the impact. In some preferred embodiments, the stopper 54 is formed from a resilient material such as, but not limited to, rubber, elastomer or felt which aids in the absorption of shock due to the impact. By means of the contact by the end section on the rear side of the jack holder 48, the range of the swinging movement of the jack holder 48 in the arrow C direction of FIG. 11(*a*) due to the biasing force of the first elastic member 52 is limited.

In preferred embodiments, the jack 42 is formed as a single body with the jack holder 48 on the lower area of the jack holder 48. In other words, the jack 42 is made into a single body with the jack holder 48 through the elastic area 208 (in this preferred embodiment, the elastic area 208 is used as a substitute for the second elastic member 56) that possesses a biasing force, similar to the second elastic member 56 to impel the jack 42 in the arrow D direction of FIG. 11 (the counterclockwise direction of FIG. 11(*a*)). Thus, it is advantageous from a manufacturing standpoint to produce the jack holder 48, the elastic area 208 and the jack 42 as a single body from materials such as resin.

At the time of the key depression, the jack 42 and the tongue plate 34 are engaged and accompany the swinging action of the hammer 22. Further, the jack 42 and the jack holder 48 couple a single body and are swung in the arrow F direction of FIG. 11(*b*) against the biasing force of the first elastic member 52 (refer to FIG. 11(*b*)). When the swinging movement of the hammer 22 advances further due to the depression of the key, the engagement between the jack 42 and the tongue plate 34 is canceled and the key depression is terminated.

In addition, at the time of the return of the key following the termination of the key depression, together with the swinging action due to the mass of the hammer 22, only the jack 42 is swung in the arrow H direction of FIG. 11(*c*) against the biasing force of the elastic area 208 (refer to FIG. 11(*c*)). Following that, the jack 42 is restored to the state shown in FIG. 11(*a*). By means of a suitable adjustment of the respective biasing forces of the first elastic member 52 and the elastic area 208, it is possible to obtain an action and effect that is the same as those previously described.

As previously stated, each of the structures that are shown in FIGS. 11(*a*)–(*c*) correspond to claimed structural elements. For instance, the first swingable member corresponds to the jack holder 48, the first biasing means corresponds to the first elastic member 52, the second swingable member corresponds to the jack 42 and the second biasing means corresponds to the shaped elastic area 208.

Figure 12:
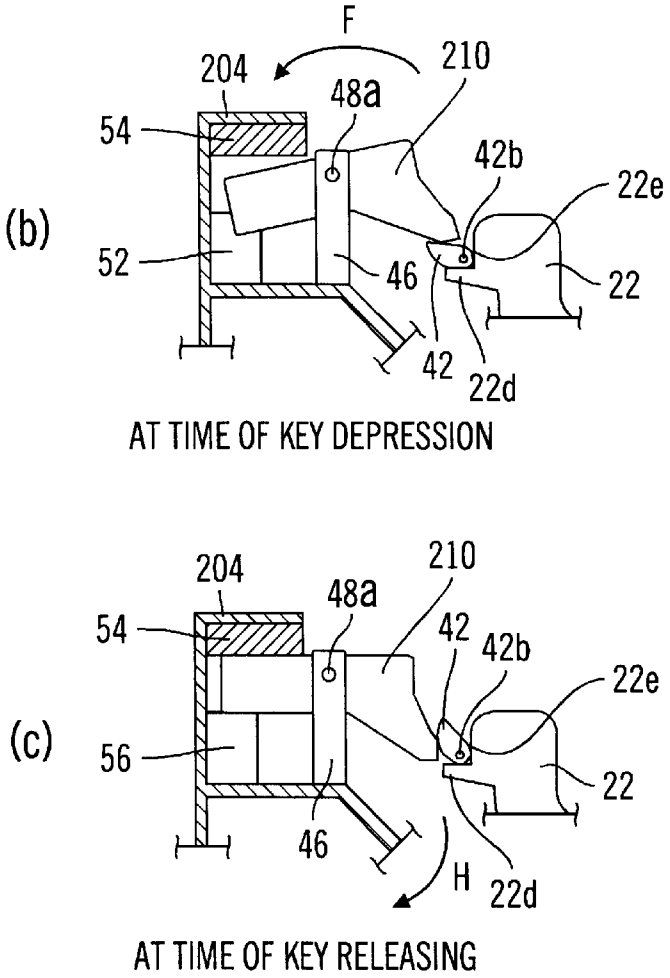
FIG. 12(*a*) is a lateral cross-section diagram of the essential elements with the let-off unit as the center in accordance with another preferred embodiment.
Figure 12:
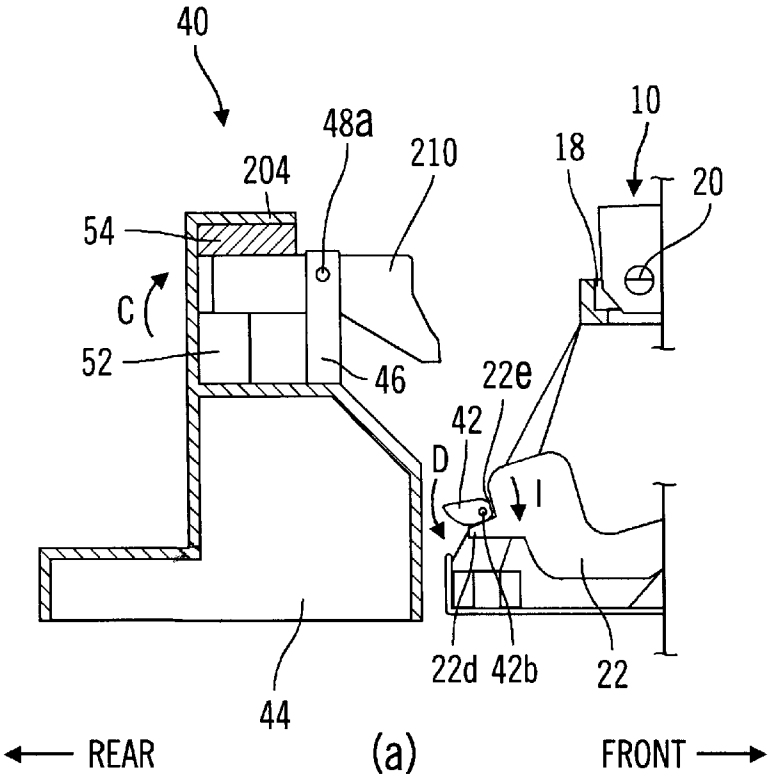

With reference to FIGS. 12(*a*)–(*c*), an explanation will be given regarding another preferred embodiment of the electronic musical instrument keyboard apparatus of the present invention. In FIGS. 12(*a*)–(*c*), identical key numbers as were used for the previously described embodiments are employed for the structures that are identical or equivalent.

FIG. 12(*a*) depicts cross-section diagram of the let-off unit of a preferred embodiment of the electronic musical instrument keyboard apparatus in accordance with the present invention. In FIG. 12(*b*), a lateral diagram that depicts the operating state of the let-off unit at the time of key depression is shown and, in FIG. 12(*c*) a lateral diagram that depicts the operating state of the let-off unit at the time of key release is shown.

In this embodiment, the bearing section 46 is formed in the area above the base chassis 44 and, as a substitute for the jack holder 48, the first swingable member 210 is supported by the bearing section 46 through the swing support shaft 48*a* so that it is free to swing. In other words, the first swingable member 210 is employed as a substitute for the jack holder 48.

The first elastic member 52, which impels the first swingable member 210 in the arrow C direction of FIG. 12(*a*) (the clockwise direction of FIG. 12(*a*)), wherein the swing support shaft 48*a* is the center, is arranged between the lower surface of the end on the rear side that has the swing support shaft 48*a* of the first swingable member 210 as its center and the upper surface of the base chassis 44. In addition, on the lower surface of the roof member 204 of the base chassis 44 that is opposite the end on the rear side that has the swing support shaft 48*a* of the first swingable member 210 as its center, the stopper 54 is arranged so that, when it comes into contact with the end section on the rear side of the first swingable member 210 by regulating the range of its swinging movement, the stopper 54 absorbs the shock of the impact. In some preferred embodiments, the stopper 54 is formed from a resilient material such as, but not limited to, rubber, elastomer or felt which aids in the absorption of shock due to the impact. By means of the contact by the end section on the rear side of the first swingable member 210, the range of the swinging movement of the first swingable member 210 in the arrow C direction of FIG. 12(*a*) due to the biasing force of the first elastic member 52 is regulated.

In preferred embodiments, the jack 42 is established on the rear end section of the hammer 22 so that it is possible for it to engage the first swingable member 210 when the hammer 22 swings. Here, the jack 42 is supported on the rear end section of the hammer 22 through the swing support shaft 42*b* so that it is free to swing.

In addition, the jack 42 is implemented so that it swings in the arrow D direction of FIG. 12(*a*) due to its mass, and its range of swinging movement, it is regulated up to the position shown in FIG. 12(*a*) by contact with the stepped section 22*d* of the hammer 22 (in other words, up to the position where it is possible for the jack 22 to engage the first swingable member 210 when the hammer 22 swings). It is not allowed to swing above that position in the arrow D direction of FIG. 12(*a*).

In addition, with regard to the jack 42 and the first swingable member 210, at the time that the key returns, which will be discussed later, the first swingable member 210 and the jack 42 engage together with the swinging of the hammer 22. The dimensions are established so that, even if the jack 42 is swung in the arrow I direction of FIG. 12(*a*), when the engagement with the first swingable member 210 is canceled, it always swings in the arrow D direction of FIG. 12(*a*) due to its mass and is restored to the position that is shown in FIG. 12(*a*). In other words, the weight due to the mass of the jack 42 is utilized as the biasing force in order to impel the jack 42 in the D direction of FIG. 12(*a*).

Further, at the time of the key depression, the jack 42 and the first swingable member 210 are engaged and accompany the swinging action of the hammer 22. The first swingable member 210 is swung in the arrow F direction of FIG. 12(*b*) against the biasing force of the first elastic member 52 (refer to FIG. 12(*b*)). When the swinging movement of the hammer 22 advances further due to the depression of the key, the engagement between the jack 42 and the first swingable member 210 is canceled and the key depression is terminated.

In addition, at the time of the return of the key following the termination of the key depression, together with the swinging action due to the mass of the hammer 22, the jack 42 is swung in the arrow H direction of FIG. 12(*c*) against the mass (refer to FIG. 12(*c*)). Following that, the jack 42 is restored to the state shown in FIG. 12(*a*). By means of a suitable adjustment of the biasing force of the first elastic member 52 and the mass of the jack 42, it is possible to obtain an action and effect that is the same as those previously described.

Each of the structures that are shown in FIGS. 12(*a*)–(*c*) correspond to claimed structural elements. For instance, the first swingable member corresponds to the hammer 22, the first biasing means corresponds to the first elastic member 52 (the biasing force is applied through the first swingable member 210), the second swingable member corresponds to the jack 42 and the second biasing means corresponds to the weight of the jack 42.

With reference to FIGS. 13–16, an explanation will be given regarding another preferred embodiment of the electronic musical instrument keyboard apparatus of the present invention. In FIG. 13 through FIG. 16, identical key numbers as were used for the previously described embodiments are employed for the structures that are identical or equivalent.

Figure 13:
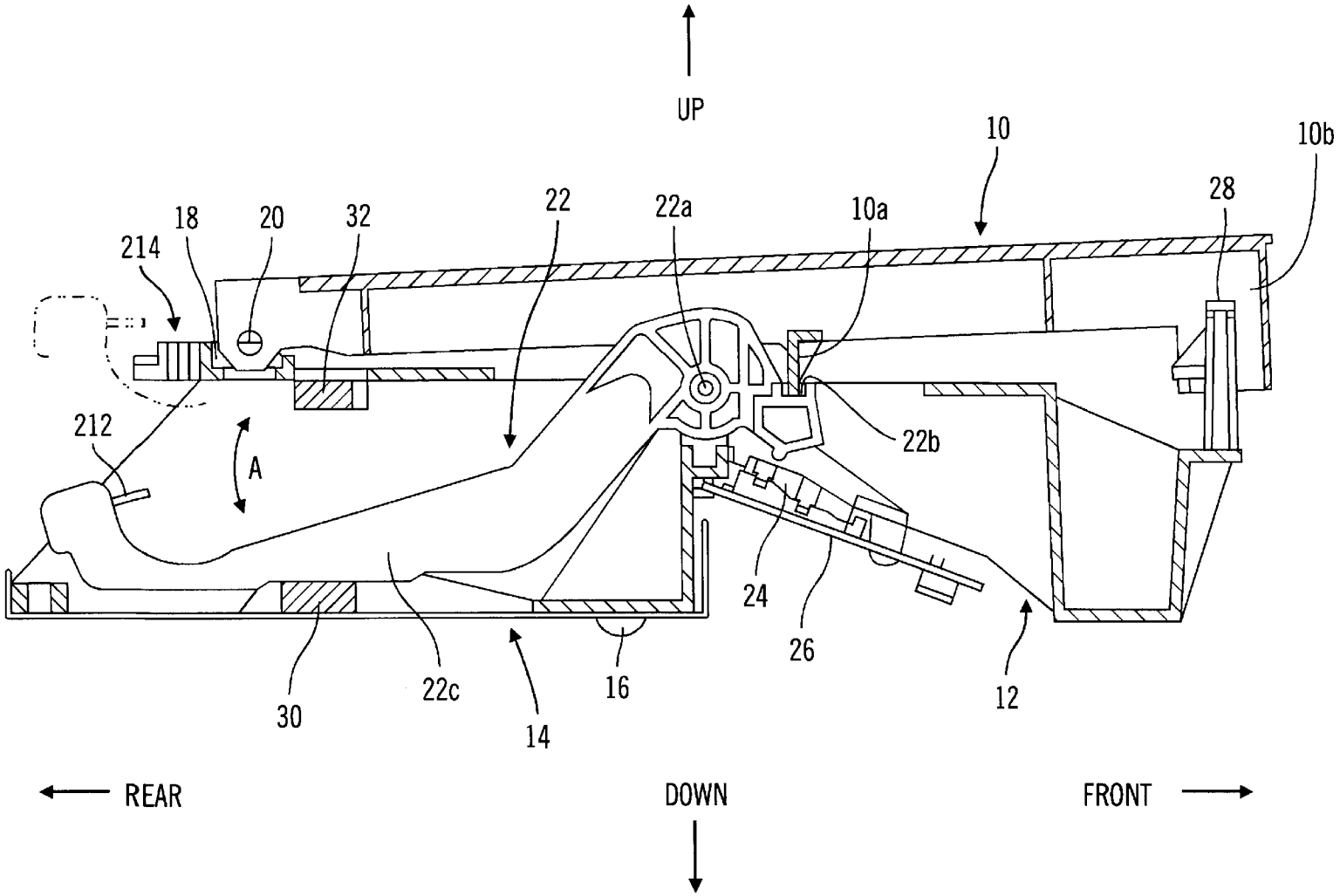
FIG. 13 is a cross-section diagram that corresponds to the preferred embodiment of FIG. 1 of the electronic musical instrument keyboard apparatus in accordance with the present invention.
Figure 14:
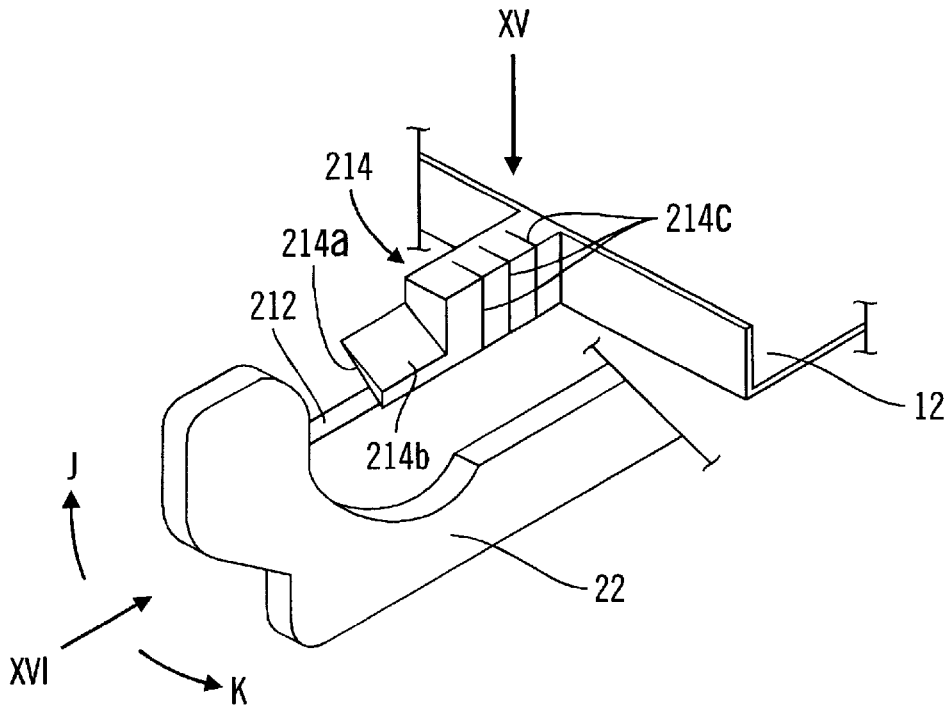
FIG. 14 is an oblique view of the essential elements of the electronic musical instrument keyboard apparatus in accordance with the preferred embodiment shown in FIG. 13.
Figure 15:
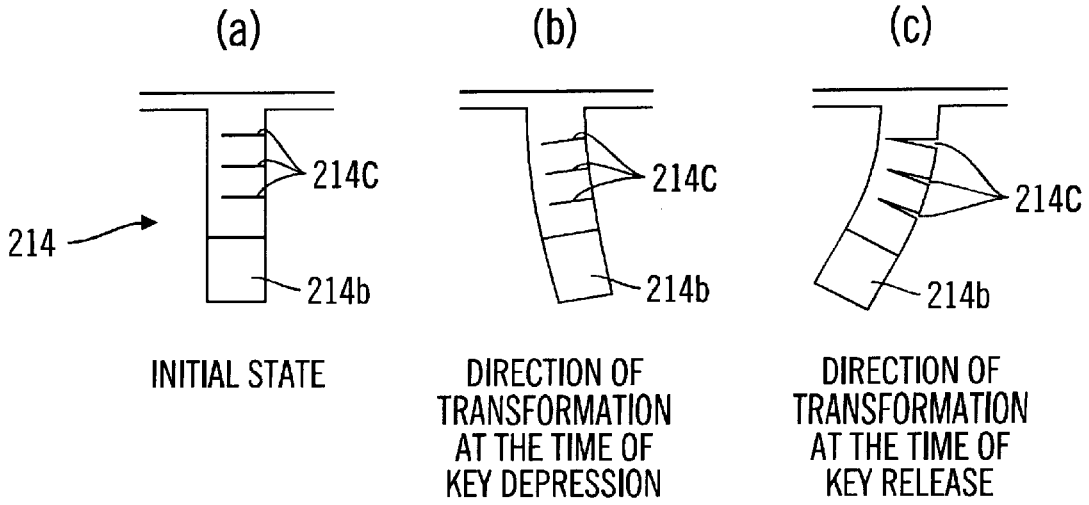
FIG. 15 is a view from the arrow XV of elements of FIG. 14.

FIG. 13 depicts a lateral cross-section diagram that corresponds to FIG. 1 of the electronic musical instrument keyboard apparatus in accordance with the present invention. FIG. 14 depicts an oblique view of the essential elements of the electronic musical instrument keyboard apparatus in accordance with the present invention as shown in FIG. 13. In FIG. 15, a view from the arrow XV of the elements of FIG. 14 is shown and in FIG. 16, a cross-section diagram viewed from the arrow XVI of the elements of FIG. 14 is shown.

In another preferred embodiment, the elastic member 214 is arranged adjacent to the key bearing section 18 of the keyboard chassis 12 in a positional relationship with the hammer protuberance 212, wherein the hammer protuberance 212 protrudes facing forward from the rear end section of the hammer 22. When the hammer 22 swings in the arrow A direction of FIG. 13, the elastic member 214 contacts the hammer protuberance 212 and it is possible for them to engage.

In some preferred embodiments, the elastic member 214 is made from a resilient material such as, but not limited to, resin, elastomer or rubber, although any resilient material may be suitable. In some preferred embodiments, the elastic member 214 is formed as a single body with the keyboard chassis 12.

With regard to the elastic member 214, when the hammer 22 is swung in the arrow A direction of FIG. 13, in conjunction with the depression and releasing of the key 10, the hammer protuberance 212 moves smoothly on the elastic member 214 both at the time of key depression and at the time of key releasing. The engagement surface of the hammer protuberance 212 is formed into the slanted faces 214*a* and 214*b* so as to make possible an elastic transformation of the elastic member 214 by the hammer protuberance 212.

To decrease the biasing force that accompanies the elastic transformation that the hammer protuberance 212 undergoes when, at the time of the key releasing, the hammer protuberance 212 and the slanted face 214*b* engage and there is an elastic transformation of the elastic member 214, incision 214*c* is formed in the expanded side face at the time of the elastic transformation of the elastic member 214. Thus, the biasing force that is received by the hammer protuberance 212 when there is an elastic transformation of the elastic member that accompanies the depression or releasing of the key 10 is greater when the key 10 is depressed than when the key 10 is released.

Figure 16:
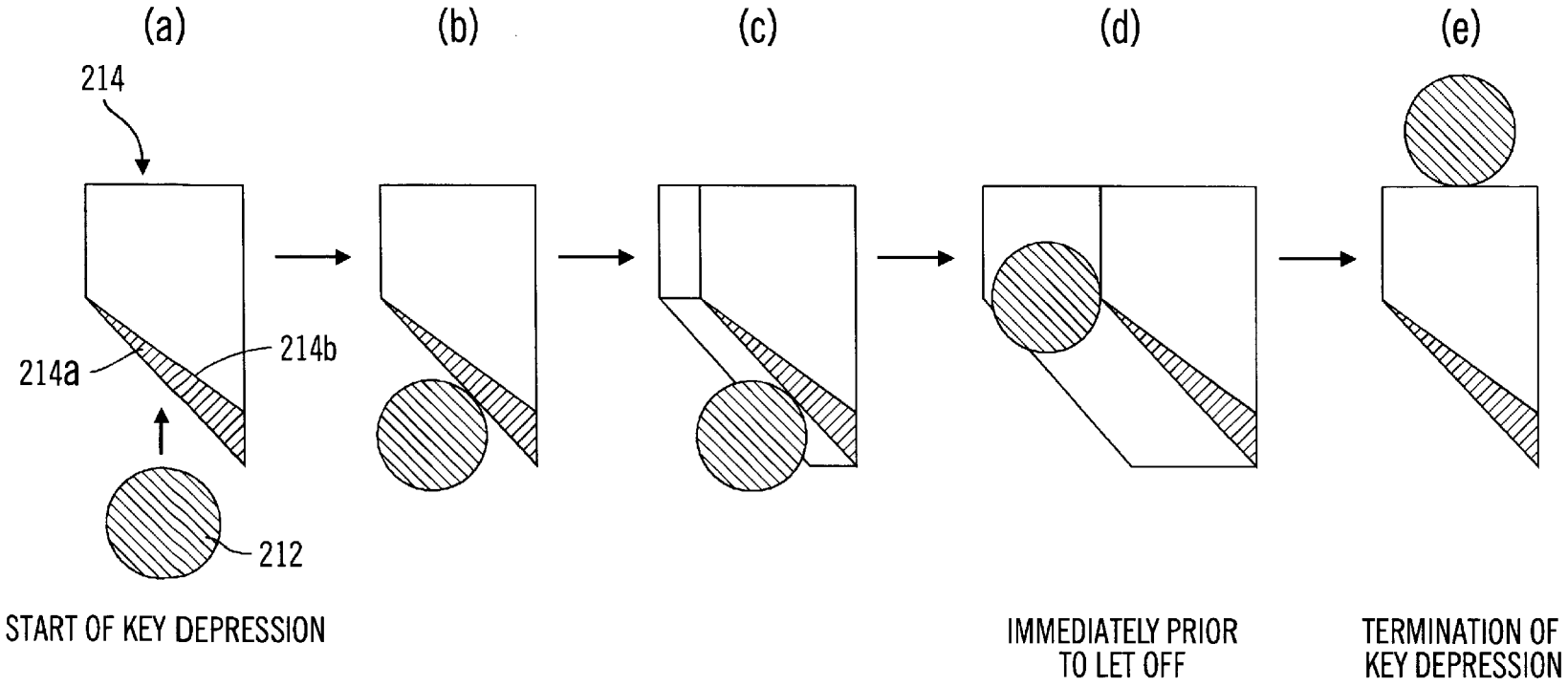
FIG. 16 is a cross-section diagram viewed from the arrow XVI of elements of FIG. 14.

In the above configuration, when the key 10 is depressed from the state shown in FIG. 13 (refer to FIG. 15(*a*) and FIG. 16(*a*) for the state in which the key 10 has been released), the actuator receiving section 22*b* of the hammer 22 is pressed downward by the actuator 10*a* of the key 10 and the hammer 22 is swung in the arrow J direction of FIG. 14 with the swing support shaft 22*a* as the fulcrum. When the swinging action in the arrow J direction of FIG. 14 of the hammer 22 advances in this manner, the hammer protuberance 212 and the slanted face 214*a* of the elastic member 214 engage (refer to FIG. 16(*b*)). In conjunction with the swinging action of the hammer 22 in the arrow J direction of FIG. 14, the hammer protuberance 212 swings in the arrow J direction of FIG. 14 so as to produce an elastic transformation of the elastic member 214 against the biasing force of the elastic member 214 due to the hammer protuberance 212 (refer to FIG. 15(*b*) and FIG. 16(*c*) and (*d*)). Thus, because of the resistance against the biasing force of the elastic transformation of the elastic member 214 in this manner, the counter force that is applied to the key at the time of the depression of the key 10 is increased and the static load is increased.

In addition, when the swinging action in the arrow J direction of FIG. 14 of the hammer 22 advances together with the depression of the key 10, the engagement between the hammer protuberance 212 and the slanted face 214 of the elastic member 214 is canceled (refer to FIG. 16(*e*)), the static load at the time that the key 10 is depressed is reduced and it is possible to obtain a let-off sensation.

Due to the cancellation of the engagement between the hammer protuberance 212 and the slanted face 214 of the elastic member 214, the elastic member 214 is restored to a state that is the same as the state shown in FIG. 15(*a*) due to elastic transformation.

At the time of the termination of the depression of the key 10 (in other words, when the keystroke of the key 10 has become a full stroke key depression), the arm section 22*c* of the hammer 22 comes into contact with the stopper 32 and the range of swinging movement is regulated. By means of the inertia of the swinging movement of the hammer 22 in this manner, it is possible to obtain a substantial touch sensation.

When the key 10 returns from the time of the termination of the key depression, in other words, from the state following the depression of the key 10 so that the keystroke is a full stroke key depression, the hammer swings in the arrow K direction of FIG. 14 due to its own weight with the swing shaft 22*a* as the fulcrum.

When the swinging movement in the arrow K direction of FIG. 14 of the hammer 22 advances, the hammer protuberance 212 and the slanted face 214*b* of the elastic member 214 engage. In conjunction with the swinging movement of the hammer 22 in the arrow K direction of FIG. 14, the hammer protuberance 212 swings in the arrow K direction of FIG. 14 so as to produce an elastic transformation of the elastic member 214 against the biasing force of the elastic member 214 due to the hammer protuberance 212 (refer to FIG. 15(*c*)). At this time, because the incision 214*c* has been formed in the expanded side face of the elastic member 214, the biasing force due to the elastic transformation can be made extraordinarily small and the static load due to the counter force that the key 10 receives because of the resistance against the biasing force from the elastic transformation of the elastic member 214 can be markedly reduced. The reduction in static load prevents any hindrance to the performance.

In conjunction with the swinging movement in the arrow K direction of FIG. 14 of the hammer 22, the actuator 10*a* of the key 10 is pushed upward by the actuator receiver section 22*b*. In addition, the arm section 22*c* of the hammer 22 collides with the stopper 30 such that they both come into contact, and thereby regulates the range of the swinging movement of the hammer 22. The key 10 and the hammer 22 are then restored to the state shown in FIG. 13.

By means of the electronic musical instrument keyboard apparatus that has been described above, in comparison to the technology of the past, it is possible to markedly reduce the change in the static load at the time that the depression of the key 10 is terminated and the key 10 returns to the position prior to depression without losing the let-off sensation at the time of the depression of the key 10. In this manner, a touch sensation that is equal to that of an acoustic piano can be obtained.

Each of the structures of the embodiment that are shown in FIG. 13 through FIG. 16 corresponds to claimed structural elements. For instance, the swingable member corresponds to the hammer 22 and the elastic member in claim 6 corresponds to the elastic member 214.

Next, an explanation will be given of another preferred embodiment of the keyboard apparatus for an electronic musical instrument in accordance with the present invention while referring to FIG. 17, FIG. 18, FIG. 19 and FIG. 20. It is to be understood that the structures in FIGS. 17–20, which are identical or similar to previously discussed figures, are identified with the same reference codes as used in the previously discussed figures.

Figure 17:
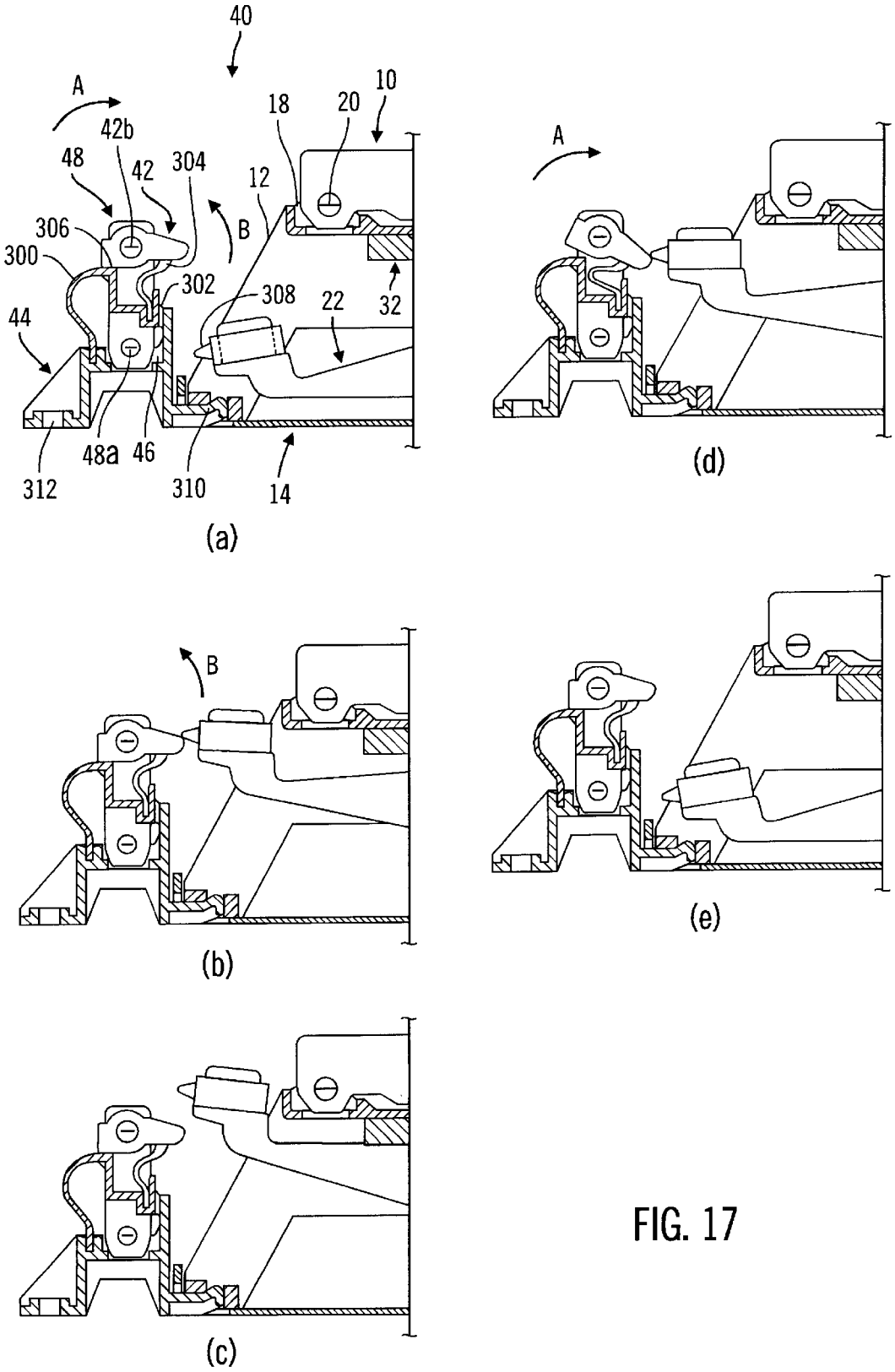
FIG. 17(*a*) is a lateral cross-section of another preferred embodiment of an electronic musical instrument.
Figure 18:
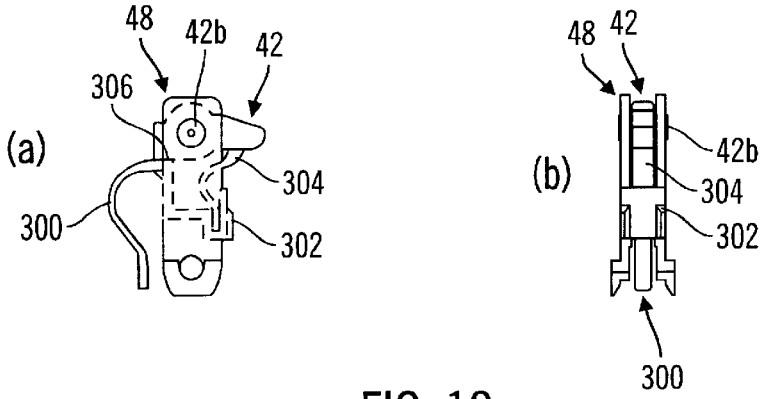
FIG. 18(*a*) depicts a lateral elevation of another preferred embodiment of jack holder and jack of the let-off unit.
Figure 19:
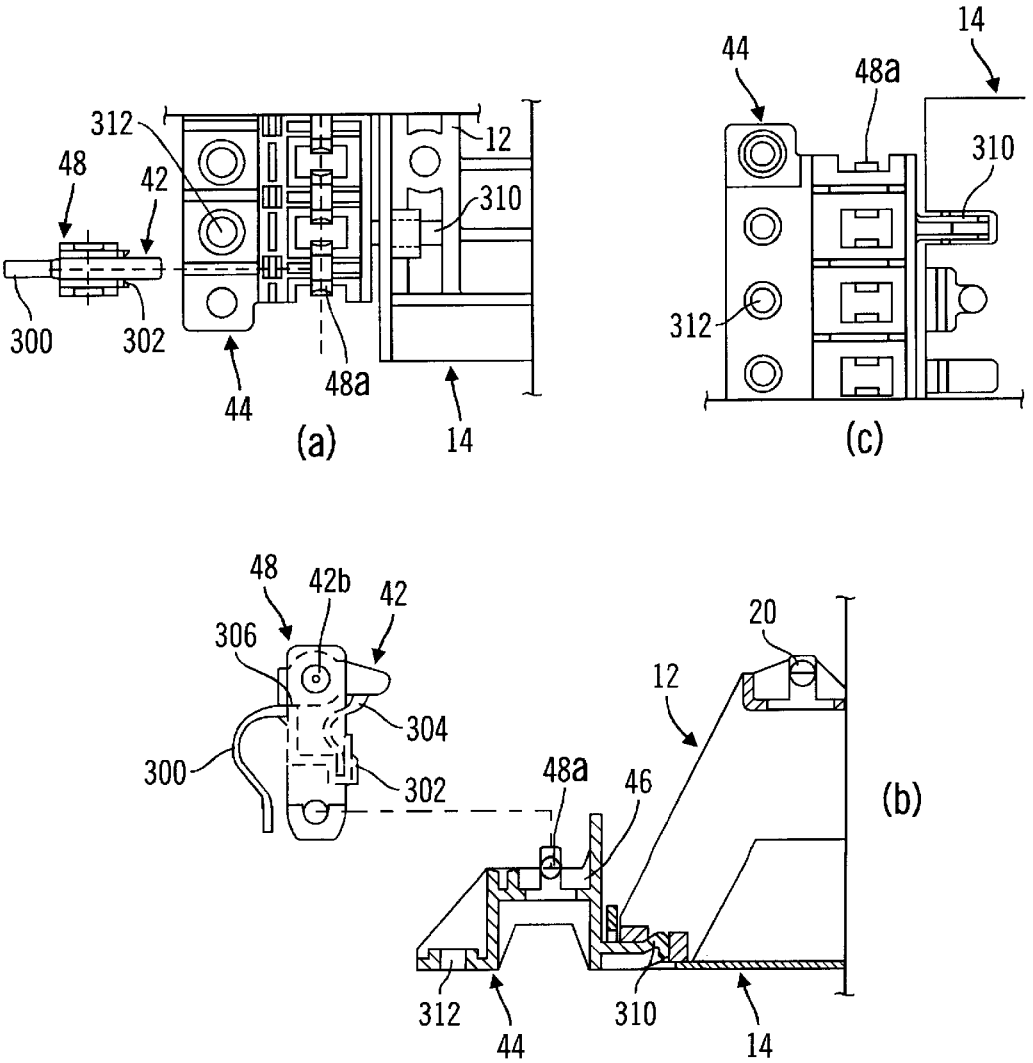
FIG. 19(*a*) depicts of top outline elevation of the let-off unit of the preferred embodiment of FIG. 17(*a*).

FIG. 17(*a*) is a lateral cross-section diagram of another preferred embodiment of the electronic musical instrument in accordance with the present invention and depicts the let-off unit. FIG. 17(*b*) and FIG. 17(*c*) are lateral cross-section diagrams depicting the action conditions of the let-off unit in the key depressing process. FIG. 17(*d*) and FIG. 17(*e*) are each cross-section diagrams depicting the action conditions of the let-off unit in the key releasing process. FIG. 18(*a*) and FIG. 18(*b*) depict a lateral elevation and a frontal elevation, respectively, of the jack holder and the jack of the let-off unit of another preferred embodiment of the electronic musical instrument in accordance with the present invention. FIG. 19(*a*), FIG. 19(*b*) and FIG. 19(*c*) depict a top outline elevation, lateral outline elevation and bottom outline elevation, respectively, of the let-off unit of the preferred embodiment of the electronic musical instrument shown in FIG. 17. To simplify the understanding of the structure in FIG. 19, the jack holder and the jack are not attached to the base chassis. Further, the hammer has been omitted. To simplify the understanding of the structure in FIG. 19(*b*), a cross-section diagram of the preferred embodiment is shown which excludes the jack holder and the jack.

In this preferred embodiment, the let-off unit 40 is formed from a material that possesses flexibility such as resin or elastomer. The let-off unit includes the base chassis 44, which comprises the base, the jack holder 48 that is supported with the interposition of the swing support shaft 48*a* and the jack 42 that is supported with the interposition of the swing support shaft 42*b*. The jack holder 48 is free to swing by the bearing section 46 which has been formed in a position that is roughly in the upper region of the center of the base chassis 44. Similarly, the jack 42 is free to swing in a location that is in the upper region of the jack holder 48. The swing support shaft 48*a* is formed as a single unit with the base chassis 44 and the swing support shaft 42*b* is formed as a single unit with the jack 42.

The curved elastic member 300 is formed so that it protrudes from the back portion roughly in the center area of the jack holder 48 such that it provides a biasing force which biases the jack holder 48 in the arrow A direction of FIG. 17(*a*), wherein the swing support shaft 48*a* as the fulcrum (the clockwise direction in FIG. 17(*a*)) and the other end of the curved elastic member is inserted behind the bearing section 46 of the base chassis 44. The receiving section 302 is established in the area that is roughly in front of the center of the jack holder 48. The receiving section 302 limits the swing of the jack holder 48 in the arrow A direction of FIG. 17(*a*) by means of the contact with the base chassis 44.

The curved elastic member 304 is formed so that it protrudes from the lower portion of the front end section that has the swing support shaft 42*b* of the jack 42 as the center such that it provides a biasing force which biases the jack 42 in the arrow B direction of FIG. 17(*a*), wherein the swing support shaft 42*b* is the fulcrum (the counterclockwise direction in FIG. 17(*a*)) and the other end of the curved elastic member 304 is inserted in the front area roughly in the center section of the jack holder 48. The receiving section 306 is established in the area that is roughly behind the center of the jack holder 48. Due to the contact of the lower portion of the rear end section having the swing support shaft 42*b* of the jack 42 as the center with the receiving section 306, the swing of the jack 42 in the arrow B direction of FIG. 17(*a*) is limited.

The hammer 22 is formed from a metallic material having a heavy weight such as lead or iron. The tongue plate 308, which is formed from a resin, is inserted into the rear end area of the hammer 22 so that it is possible to become engaged with the front end portion of the jack 42 at the time that the hammer 22 swings.

As has been shown above, in this preferred embodiment, the let-off unit 40 is composed of only the base chassis 44, the jack holder 48 and the jack 42. That is, the jack holder 48 in this preferred embodiment is not patterned on only the action of the jack holder 48 but also the actions of the first elastic member 52 and the stopper 54 that are shown in the first embodiment. The jack 42 in this preferred embodiment is not patterned on only the action of the jack 42, but also the actions of the second elastic member 56, the stopper 58 and the shock absorbing member 60 that are shown in the first embodiment. Thus, the number of components composing the let-off unit 40 have been markedly reduced in this embodiment in comparison to the first embodiment. In addition, the jack holder 48 of this preferred embodiment is shaped long in the vertical direction and the let-off unit is, as a whole, compactly configured in the direction of its depth.

In this embodiment, at the time of depressing a key, together with the swinging movement of the hammer 22, the jack 42 and the tongue plate member 308 become engaged. Because the lower area of the rear end section of the jack 42 comes into contact with the receiver section 306 of the jack 42, the jack 42 and the jack holder 48 become a single unit and there is a swinging action in the arrow B direction of FIG. 17(*b*) resisting the biasing force of the curved elastic member 300 (refer to FIG. 17(*b*)). When the swinging movement of the hammer 22 progresses further due to the depressing of the key, the engagement between the jack 42 and the tongue plate member 308 is canceled. When the key depressing is terminated, the jack holder 48 swings in the arrow A direction of FIG. 17(*a*) until the receiver section 302 comes into contact with the base chassis 44 due to the action of the curved elastic member 300 and it is restored to its original position (refer to FIG. 17(*c*)).

At the time of the key return following the termination of key depressing, coupled with the swinging action due to the weight of the hammer 22, the jack 42 and the tongue plate 308 become engaged. In this instance, only the jack 42 resists the biasing force of the curved elastic member 304 and it is swung in the arrow A direction of FIG. 17(*b*) (refer to FIG. 17(*d*)). When the swinging movement of the hammer progresses further due to releasing of the key, the engagement between the jack 42 and the tongue plate member 308 is canceled, the key releasing is terminated, the jack 42 swings in the arrow B direction of FIG. 17(*a*) until the lower area of the rear end section of the jack 42 comes into contact with the receiver section 306 due to the action of the curved elastic member 304 and it is restored to its original position (refer to FIG. 17(*e*)).

By means of a suitable adjustment of the respective biasing forces of the curved elastic member 300 and the curved elastic member 304, it is possible to achieve the same kind of action and effect as observed in previously described embodiments.

Figure 20:
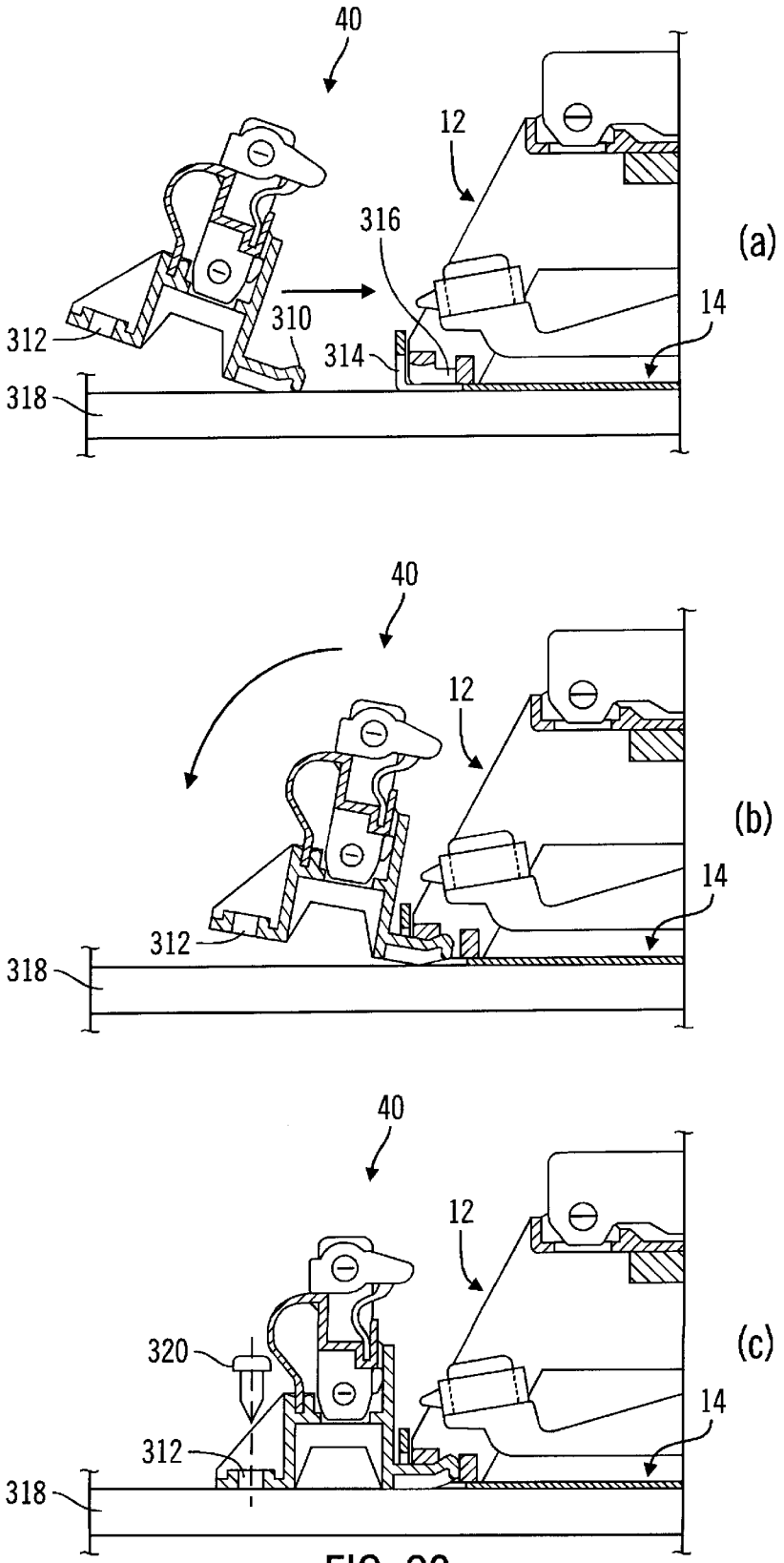
FIG. 20(*a*) depicts the let-off unit prior to joining the let-off units to the main body of the keyboard apparatus.

FIG. 20(*a*), FIG. 20(*b*) and FIG. 20(*c*) depicts the method for joining the let-off unit to the main body of the keyboard apparatus of the preferred of the electronic musical instrument embodiment depicted in FIGS. 17(*a*)–(*e*) in accordance with the present invention.

The position determining section 310 is established on the front area of the base chassis 44 of the let-off unit 40 and the screw clamp hole 312 is established on the rear area. In addition, a first notched section 314 is established in the rear area of the bottom chassis 14 of the keyboard apparatus main body and a second notched section 316 is established in the rear area of the keyboard chassis 12 of the keyboard apparatus main body.

At the time of assembly, the main body of the keyboard apparatus is fixed to the bottom board 318, which is made of wood, by means of screws which are not shown in the figure. With reference to FIG. 20(*b*), the position determining section 310 is inserted into the first notched section 314 and the second notched section 316. The position determining section 310 comes into contact with the second notched section 316 and a position determination is made for the let-off unit 40. With reference to FIG. 20(*c*), the let-off unit 40 is fixed to the bottom board via the screw hole 312 by means of the screw 320. Because the let-off unit 40 comes into contact with the main body of the keyboard apparatus and position determination is made in this manner, it is possible to easily set up the positional relationship between the tongue plate member 308 that is inserted into the hammer 22 and the jack 42 of the let-off unit 40 with a high degree of accuracy and a favorable touch sensation can be easily obtained.

By means of the removal of the screw 320 at the time of disassembly, it is possible to remove the let-off unit 40 from the bottom board 318 with the main body of the keyboard apparatus remaining fixed to the bottom board 318. Conversely, it is also possible to remove the main body of the keyboard apparatus from the bottom board 318 with the let-off unit 40 remaining fixed to the bottom board. Because of this, in those cases where the main body of the keyboard apparatus or the let-off unit 40 has suffered damage, it is possible to easily exchange either one.

It is to be understood that each of the structures of the above described preferred embodiment that is shown in FIG. 17 and FIG. 18 corresponds, as indicated below, to claimed structural elements. For instance, the first swingable member in the claims corresponds to the jack holder 48, the first biasing means corresponds to the curved elastic member 300, the second swingable member corresponds to the jack 42 and the second biasing means corresponds to the curved elastic member 304.

In the above described embodiments that have been explained in the above descriptions, the design is such that the performer can experience a let-off sensation due to the action of such things as each of the swingable members and elastic members through the hammer 22 in the key depression and key releasing processes. However, this is, of course, not intended to be limited in this manner. For instance, it may be implemented so that the action is performed with each of the units such as the swingable members and the elastic members positioned below the center portion of the key 10 in the long direction (the front-back direction in FIG. 1) and operated not by the hammer 22 but, for example, by a portion of the key 10 (for example, the lower portion of the side wall of the key 10). Therefore, in alternative embodiments of the present invention the transmitting member may be the key 10. By means of this method, the thickness of the keyboard apparatus itself becomes thicker, but it can be made compact with respect to the depth of the key.

In addition, in the above described embodiments, the biasing force that is generated in the key depression process is produced by the elastic member. However, this is, of course, not intended to limit the invention, but rather, the biasing force may be generated by other means, such as, for example, weighting with a mass. Indeed any configuration that generates a biasing force at the time of key depression such that the performer can experience a let-off sensation is suitable.

Although the foregoing described the invention with preferred embodiments, this is not intended to limit the invention. Rather, the foregoing is intended to cover all modifications and alternative constructions falling within the spirit and scope of the invention as expressed in the appended claims.

What is claimed is:

1. An electronic musical instrument keyboard apparatus having a key, wherein the key includes a depressing action and a releasing action comprising:

a first swingable member that is established so that it can freely swing in accordance with the depressing action of the key;

a first biasing means that applies a bias to the first swingable member and applies a first counter force to the key that resists the depressing action;

a second swingable member that is established so that it cannot swing with respect to the first swingable member during the depressing action of the key and, together with this, is established so that it is free to swing with respect to the first swingable member during the releasing action of the key;

a second biasing means that applies a bias to the second swingable member and applies a second counter force to the key that resists the releasing action and is smaller than the first counter force;

wherein in accordance with the depressing action of the key, in a portion of the depressing process for the key, the first swingable member and second swingable member swing as a unit against the biasing due to the first biasing means; and wherein in accordance with the releasing action of the key, in a portion of the releasing process for the key, the second swingable member swings independently against the biasing due to the second biasing means.

2. For the electronic musical instrument keyboard apparatus cited in claim 1, the electronic musical instrument keyboard apparatus further comprising:

a hammer that is established so that it is free to swing in accordance with the depressing action and the releasing action of the key;

wherein in the portion of the depressing process for the key, the hammer and the second swingable member are engaged and, together with the swinging movement of the hammer, the first swingable member and the second swingable member swing as a single unit with the swinging movement fulcrum of the first swingable member as the center of swinging movement and, after that, the engagement between the hammer and the second swingable member is canceled; and wherein in a portion of the releasing process for the key, the hammer and the second swingable member are engaged and, together with the swinging movement of the hammer, the second swingable member swings independently with the swinging movement fulcrum of the second swingable member as the center of swinging movement.

3. For the electronic musical instrument keyboard apparatus cited in claim 2, the electronic musical instrument keyboard apparatus wherein the swinging movement fulcrum of the second swingable member is established more on the side in the direction of swinging movement of the first swingable member than the line extended from the engagement locus of the hammer and the second swingable member and the swinging movement fulcrum of the first swingable member; and prior to the cancellation of the engagement between the hammer and the second swingable member, when the key is released, at least the second swingable member swings with the swinging movement fulcrum of the second swingable member as the center of swinging movement.

4. For the electronic musical instrument keyboard apparatus cited in claim 2, the electronic musical instrument keyboard apparatus further comprises:

a shock absorbing member that is established at the engagement locus of the hammer and the second swingable member; wherein the shock absorbing member is formed in a single unit with the second biasing means.

5. For the electronic musical instrument keyboard apparatus cited in claim 3, the electronic musical instrument keyboard apparatus further comprises:

a shock absorbing member that is established at the engagement locus of the hammer and the second swingable member; wherein the shock absorbing member is formed in a single unit with the second biasing means.

6. An electronic musical instrument as claimed in claim 1, wherein the first swingable member and the first biasing means are formed in a single unit by a first elastic material and, the second swingable member and the second biasing means are formed in a single unit by a second elastic material.

7. An electronic musical instrument keyboard apparatus comprises:

a swingable member that is established so that it can freely swing in accordance with the depressing action of the key; and an elastic member that together with applying a bias to the swingable member and applying a first counter force to the key that resists the depressing action, applying a second counter force to the key that resists the releasing action and is smaller than the first counter force; wherein in accordance with the depressing action of the key, in a portion of the depressing process for the key, the swingable member swings against the first counter force and; wherein in accordance with the releasing action of the key, in a portion of the releasing process for the key, the swingable member swings against the second counter force.

8. An electronic musical instrument keyboard apparatus comprising:

a transmitting member including a depressing action and a releasing action;

a first swingable member that is established so that it can freely swing in accordance with the depressing action of the transmitting member;

a first biasing means that applies a bias to the first swingable member and applies a first counter force to the transmitting member that resists the depressing action;

a second swingable member that is established so that it cannot swing with respect to the transmitting member during the depressing action of the transmitting member and, together with this, is established so that it is free to swing with respect to the transmitting member during releasing action of the transmitting member;

a second biasing means that applies a bias to the second swingable member and applied a second counter force to the transmitting member that resists the releasing action and is smaller than the first counter force;

wherein in accordance with the depressing action of the transmitting member, in a portion of the depressing action, the depressing action is transmitting to the first swingable member through the second swingable member, the first swingable member swings against the biasing due to the first biasing means; and wherein in accordance with the releasing action of the transmitting member, in a portion of the releasing process, the second swingable member swings against the biasing due to the second biasing means.

9. An electronic musical instrument keyboard apparatus as recited in claim 8, further including a key having a key depressing action and a key releasing action;

wherein the transmitting member is a hammer configured to freely swing during the key depressing action and the key releasing action.

10. An electronic musical instrument keyboard apparatus having a key, the key including a depressing action and a releasing action, the keyboard apparatus comprising:

a first swingable member supported for swinging movement in accordance with the depressing action of the key;

a resilient member adjacent to the first swingable member for applying a first bias to the first swingable member and a first counterforce to the key that resists the depressing action of the key; and a second swingable member supported so that it cannot swing with respect to the first swingable member during the depressing action of the key, but is free to swing with respect to the first swingable member during the releasing action of the key;

wherein a second bias is applied to the second swingable member, producing a second counterforce on the key that resists the releasing action of the key;

wherein the second counterforce is smaller than the first counterforce;

wherein during a portion of the depressing action of the key, the first swingable member and second swingable member swing as a unit against the first bias from the resilient member; and wherein during a portion of the releasing action of the key, the second swingable member swings independent from the first swingable member against the second bias.

11. An electronic musical instrument keyboard apparatus as recited in claim 10, further including a chassis for supporting the first swingable member, the resilient member, and the second swingable member;

wherein the first swingable member comprises a substantially rigid body pivotably coupled to the chassis.

12. An electronic musical instrument keyboard apparatus as recited in claim 10, wherein the resilient member comprises an elastic material.

13. An electronic musical instrument keyboard apparatus as recited in claim 10, wherein the second swingable member comprises a substantially rigid body pivotably coupled to the first swingable member.

14. An electronic musical instrument keyboard apparatus as recited in claim 10, wherein the second bias is produced by a biasing member comprising an elastic material.

15. An electronic musical instrument keyboard apparatus as recited in claim 10, wherein the second bias is produced by a weight of the second swingable member.

16. An electronic musical instrument keyboard apparatus as recited in claim 10, further including a hammer supported for swinging movement in accordance with the depressing action and releasing action of the key:

wherein during a portion of the depressing action of the key, the hammer and the second swingable member are engaged and, together with the swinging movement of the hammer, the first swingable member and the second swingable member swing as a single unit with a swing fulcrum of the first swingable member as a center of swinging movement;

wherein after the depressing action of the key has substantially concluded, the engagement between the hammer and the second swingable member is canceled; and wherein during a portion of the releasing action of the key, the hammer and the second swingable member are again engaged and, together with the swinging movement of the hammer, the second swingable member swings independent from the first swingable member with a swing fulcrum of the second swingable member as the center of swinging movement.

17. An electronic musical instrument keyboard apparatus as recited in claim 16, wherein the swing fulcrum of the second swingable member is located above a line extending from an engagement locus of the hammer and the second swingable member and the swing fulcrum of the first swingable member.

18. An electronic musical instrument keyboard apparatus as recited in claim 16, the electronic musical instrument keyboard apparatus further comprising a shock absorbing member supported between the hammer and the second swingable member for buffering the engagement of the hammer and the second swingable member.

19. An electronic musical instrument keyboard apparatus as recited in claim 18, wherein the shock absorbing member is a resilient material formed in a single unit with the biasing member.

20. An electronic musical instrument keyboard apparatus as recited in claim 17, the electronic musical instrument keyboard apparatus further comprising a shock absorbing member supported between the hammer and the second swingable member for buffering the engagement of the hammer and the second swingable member.

21. An electronic musical instrument keyboard apparatus as recited in claim 20, wherein the shock absorbing member is a resilient material formed in a single unit with the biasing member.

22. An electronic musical instrument keyboard apparatus as recited in claim 10:

wherein the first swingable member and the resilient member are formed in a single unit by a first elastic material;

wherein the second bias is produced by a biasing member; and wherein the second swingable member and the biasing member are formed in a single unit by a second elastic material.

23. An electronic musical instrument keyboard apparatus comprising:

a transmitting member including a depressing action and a releasing action;

a first swingable member supported for swing movement in accordance with the depressing action of the transmitting member;

a resilient member adjacent to the first swingable member for applying a first bias to the first swingable member and a first counterforce to the transmitting member that resists the depressing action of the transmitting member;

a second swingable member supported so that it cannot swing with respect to the transmitting member during the depressing action of the transmitting member, but is free to swing with respect to the transmitting member during the releasing action of the transmitting member;

wherein a second bias is applied to the second swingable member, producing a second counterforce on the transmitting member that resists the releasing action of the transmitting member;

wherein the second counterforce is smaller that the first counterforce;

wherein during a portion of the depressing action of the transmitting member, the depressing action is transmitted to the first swingable member through the second swingable member, the first swingable member swings against the bias from the resilient member; and wherein during a portion of the releasing action of the transmitting member, the second swingable member swings against the second bias.

24. An electronic musical instrument keyboard apparatus as recited in claim 23, further including a key having a key depressing action and a key releasing action;

wherein the transmitting member is a hammer configured to freely swing during the key depressing action and the key releasing action.

25. An electronic musical instrument keyboard apparatus as recited in claim 23, wherein the second bias is produced by a weight of the second swingable member.

26. A keyboard apparatus for an electronic musical instrument, the keyboard apparatus comprising:

a chassis;

a plurality of transmitting members supported on the chassis, each transmitting member including a depressing action and a releasing action;

a first swingable member coupled to the chassis for swinging in a first direction in accordance with the depressing action of a corresponding transmitting member and for swinging in a second direction opposite to the first direction, wherein when the first swingable member is urged toward the chassis in a first swinging position, the swing in the second direction is limited;

a first biasing member supported between the chassis and the first swingable member for applying a first bias to the first swingable member that biases the first swingable member in the second direction and for applying a first counterforce to the transmitting member that resists the depressing action of the transmitting member;

a second swingable member coupled to the first swingable member for swinging in the second direction in accordance with the releasing action of the transmitting member, wherein when the second swingable member is urged toward the first swingable member in a second swinging position, the swing of the second swingable member in the first direction is limited; and a second biasing member supported between the first swingable member and the second swingable member for applying a second bias to the second swingable member that biases the second swingable member in the first direction and for applying a second counterforce to the transmitting member that resists the releasing action of the transmitting member;

wherein the second counterforce is smaller than the first counterforce;

wherein the transmitting member momentarily engages the second swingable member during the depressing and releasing action of the transmitting member;

wherein during a portion of the depressing action of the transmitting member, the transmitting member engages the second swingable member and transmits the depressing action of the transmitting member to the second swingable member in the first direction, and the first swingable member and the second swingable member swing as a single unit in the first direction against the first bias from the first biasing member;

wherein after the depressing action of the transmitting member has substantially concluded, the engagement between the transmitting member and the second swingable member is canceled, and the first swingable member and the second swingable member swing as a single unit in the second direction to the first swinging position due to the first bias from the first biasing member;

wherein during a portion of the releasing action of the transmitting member, the transmitting member engages the second swingable member and transmits the releasing action of the transmitting member to the second swingable member in the second direction, and the second swingable member swings independent from the first swingable member in the second direction against the second bias from the second biasing member; and wherein after the releasing action of the transmitting member has substantially concluded, the engagement between the transmitting member and the second swingable member is canceled, and the second swingable member swings independent from the first swingable member in the first direction to the second swinging position due to the second bias from the second biasing member.

27. A keyboard apparatus for an electronic musical instrument as recited in claim 26, further including a plurality of keys, each key including a depressing action and a releasing action for engaging a corresponding transmitting member:

wherein the first swingable member further comprises a swing fulcrum;

wherein the second swingable member further comprises a swing fulcrum;

wherein each transmitting member is a hammer configured to freely swing during the depressing action and releasing action of a corresponding key;

wherein during a portion of the depressing action of the hammer when the hammer and the second swingable member are engaged, the first swingable member and the second swingable member swing as a single unit with the swing fulcrum of the first swingable member as a center of swinging movement, and wherein during a portion of the releasing action of the hammer when the hammer and the second swingable member are engaged, the second swingable member swings independent from the first swingable member with the swinging movement fulcrum of the second swingable member as the center of swinging movement.

28. A keyboard apparatus for an electronic musical instrument as recited in claim 27, wherein the swing fulcrum of the second swingable member is located above a line extending from a position of engagement between the hammer and the second swingable member and the swing fulcrum of the first swingable member.

29. A keyboard apparatus for an electronic musical instrument as recited in claim 27, further comprising an elastic member supported between the hammer and the second swingable member for buffering the engagement of the hammer and the second swingable member.

30. An keyboard apparatus for an electronic musical instrument as recited in claim 29, wherein the elastic member is a resilient material formed in a single unit with the second biasing member.

31. A keyboard apparatus for an electronic musical instrument as recited in claim 28, further comprising an elastic member supported between the hammer and the second swingable member for buffering the engagement of the hammer and the second swingable member.

32. An keyboard apparatus for an electronic musical instrument as recited in claim 31, wherein the elastic member is a resilient material formed in a single unit with the second biasing member.

33. A keyboard apparatus for an electronic musical instrument as recited in claim 26:

wherein the first swingable member and the first biasing member are formed as a single unit by a first elastic material; and the second swingable member and the second biasing member are formed as a single unit by a second elastic material.

* * * * *